US010224661B2

(12) United States Patent
Wagman et al.

(10) Patent No.: US 10,224,661 B2
(45) **Date of Patent: *Mar. 5, 2019**

(54) LOW-PROFILE SPRING-LOADED CONTACTS

(71) Applicant: Apple Inc., Cupertino, CA (US)

(72) Inventors: Daniel C. Wagman, Scotts Valley, CA (US); Mahmoud Amini, Sunnyvale, CA (US); Eric S. Jol, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/102,529

(22) Filed: Aug. 13, 2018

(65) Prior Publication Data

US 2018/0375244 A1 Dec. 27, 2018

Related U.S. Application Data

(63) Continuation-in-part of application No. 15/894,321, filed on Feb. 12, 2018, now Pat. No. 10,050,368, which is a continuation of application No. 15/138,224, filed on Apr. 26, 2016, now Pat. No. 9,893,452.

(Continued)

(51) Int. Cl.

| | |
|---|---|
| ***H01R 13/44*** | (2006.01) |
| ***H01R 13/24*** | (2006.01) |
| ***H01R 13/41*** | (2006.01) |
| ***H01R 43/20*** | (2006.01) |
| ***H01R 43/16*** | (2006.01) |
| ***H01R 13/428*** | (2006.01) |

(52) U.S. Cl.
CPC ..... *H01R 13/2442* (2013.01); *H01R 13/2421* (2013.01); *H01R 13/41* (2013.01); *H01R 13/428* (2013.01); *H01R 43/16* (2013.01); *H01R 43/20* (2013.01); *H01R 13/2471* (2013.01); *H01R 13/2478* (2013.01)

(58) Field of Classification Search
CPC ..... H01R 13/4536; H01R 13/447; H01R 13/65802; H01R 11/288
USPC ..... 439/138, 136, 892, 95, 910
See application file for complete search history.

(56) References Cited

U.S. PATENT DOCUMENTS

| | | | |
|---|---|---|---|
| 5,213,314 | A | 5/1993 | Kano et al. |
| 5,295,844 | A | 3/1994 | Koshikawa |

(Continued)

FOREIGN PATENT DOCUMENTS

| | | |
|---|---|---|
| CN | 101755368 | 6/2010 |
| JP | H0577772 | 10/1993 |

(Continued)

OTHER PUBLICATIONS

Ex parte Quayle Action dated Jun. 27, 2017 in U.S. Appl. No. 15/256,470, 8 pages.

(Continued)

*Primary Examiner* — Phuong Chi T Nguyen
(74) *Attorney, Agent, or Firm* — Kilpatrick Townsend & Stockton, LLP

(57) ABSTRACT

Contact structures that are readily manufactured, where contacts in the contact structures provide a sufficient normal force while consuming a minimal amount of surface area, depth, and volume in an electronic device.

20 Claims, 32 Drawing Sheets

Related U.S. Application Data

(60) Provisional application No. 62/215,592, filed on Sep. 8, 2015.

(56) References Cited

U.S. PATENT DOCUMENTS

| | | | | |
|---|---|---|---|---|
| 5,980,335 | A | 11/1999 | Barbieri et al. | |
| 7,306,494 | B2 | 12/2007 | Soh | |
| 7,661,968 | B1 | 2/2010 | Duan | |
| 7,662,000 | B2 | 2/2010 | Hou | |
| 8,066,518 | B2 | 11/2011 | Homme et al. | |
| 8,344,836 | B2 | 1/2013 | Lauder | |
| 8,427,825 | B2 * | 4/2013 | Szczypinski | H04M 1/0262 29/592.1 |
| 8,498,100 | B1 | 7/2013 | Whitt, III | |
| 8,570,725 | B2 | 10/2013 | Whitt, III | |
| 8,699,215 | B2 | 4/2014 | Whitt, III | |
| 8,724,302 | B2 | 5/2014 | Whitt, III | |
| 8,780,540 | B2 | 7/2014 | Whitt, III | |
| 8,780,541 | B2 | 7/2014 | Whitt, III | |
| 8,830,668 | B2 | 9/2014 | Whit, III | |
| 8,873,227 | B2 | 10/2014 | Whitt, III | |
| 8,878,637 | B2 | 11/2014 | Sartee | |
| 8,903,517 | B2 | 12/2014 | Perek | |
| 8,947,864 | B2 | 2/2015 | Whitt, III | |
| 8,953,310 | B2 | 2/2015 | Smith | |
| 8,975,991 | B2 | 3/2015 | Lauder | |
| 8,988,876 | B2 | 3/2015 | Corbin | |
| 9,000,871 | B2 | 4/2015 | Cencioni | |
| 9,036,340 | B1 | 5/2015 | Colby | |
| 9,075,566 | B2 | 7/2015 | Whitt, III | |
| 9,149,100 | B2 | 10/2015 | Marshall | |
| 9,158,384 | B2 | 10/2015 | Whitt, III | |
| 9,176,900 | B2 | 11/2015 | Whitt, III | |
| 9,176,901 | B2 | 11/2015 | Whitt, III | |
| 9,331,415 | B2 * | 5/2016 | Tagawa | H01R 12/716 |
| 9,335,793 | B2 | 5/2016 | Rothkopf | |
| 9,455,759 | B2 | 9/2016 | Jen | |
| 9,485,338 | B2 | 11/2016 | Balaji | |
| 9,893,452 | B2 * | 2/2018 | Wagman | H01R 13/2421 |
| 10,050,368 | B2 * | 8/2018 | Wagman | H01R 13/2421 |
| 2004/0209489 | A1 * | 10/2004 | Clapper | H01R 13/6205 439/39 |
| 2005/0026499 | A1 | 2/2005 | Choi | |
| 2009/0247004 | A1 | 10/2009 | Lou | |
| 2009/0257207 | A1 * | 10/2009 | Wang | G06F 1/1626 361/752 |
| 2010/0328230 | A1 | 12/2010 | Faubert | |
| 2011/0051360 | A1 | 3/2011 | Dabov | |
| 2012/0194448 | A1 | 8/2012 | Rothkopf | |
| 2013/0035006 | A1 | 2/2013 | Park | |
| 2013/0162554 | A1 | 6/2013 | Lauder | |
| 2013/0183861 | A1 | 7/2013 | Chang et al. | |
| 2014/0106594 | A1 | 4/2014 | Skvoretz | |
| 2014/0204514 | A1 | 7/2014 | Whitt, III | |
| 2014/0273546 | A1 | 9/2014 | Harmon | |
| 2014/0377992 | A1 | 12/2014 | Chang et al. | |
| 2015/0194764 | A1 | 7/2015 | Magana | |

FOREIGN PATENT DOCUMENTS

| | | |
|---|---|---|
| JP | H0662474 | 9/1994 |
| JP | H083932 | 1/1996 |
| JP | S6323776 | 2/1998 |
| JP | H11329634 | 11/1999 |
| JP | 2013182839 | 9/2013 |
| KR | 10-2006-0039930 | 5/2006 |
| KR | 10-2013-0015367 | 2/2013 |

OTHER PUBLICATIONS

European Search Report dated Jan. 20, 2017 in European Patent Application No. 16186530.8, 12 pages.
Examination Report No. 1 dated Apr. 27, 2017 in Australian Patent Application No. 20162225604, 4 pages.
Office Action and Search Report (English Translation) dated May 25, 2017 in Taiwan Patent Application No. 105128162,3 pages.
Office Action (English Translation) dated Jul. 18, 2017 in Korean Patent Application No. 10-2016-0112084, 8 pages.
First Action Interview Pilot Program Pre-Interview Communication dated Aug. 31, 2017 in U.S. Appl. No. 15/476,829, 4 pages.
Evaluation Report for Utility Model Patent (English Translation) dated Sep. 13, 2017 in Chinese Patent Application No. ZL2016210423187, 19 pages.
Office Action dated Oct. 24, 2017 in European Patent Application No. 16186530.8, 9 pages.

* cited by examiner

RANDOMIZATION TABLE

| Point | X | Y |
|---|---|---|
| 1 | 5 | 5 |
| 2 | -4 | 5 |
| 3 | 1 | -2 |
| 4 | -4 | 5 |
| 5 | 4 | -5 |
| 6 | 0 | 3 |
| 7 | -3 | 2 |
| 8 | 3 | 1 |
| 9 | -1 | -5 |
| 10 | 5 | 5 |
| 11 | -1 | 1 |
| 12 | -1 | 1 |
| 13 | -5 | 5 |
| 14 | 3 | -4 |
| 15 | -4 | 3 |
| 16 | 1 | 1 |
| 17 | 2 | -1 |
| 18 | -2 | -5 |
| 19 | 2 | 1 |
| 20 | -5 | 4 |
| 21 | 2 | -5 |
| 22 | 0 | -5 |
| 23 | 1 | 3 |
| 24 | -4 | -2 |
| 25 | 5 | 1 |
| 26 | -4 | 5 |
| 27 | -2 | -5 |
| 28 | -3 | -4 |
| 29 | 4 | 3 |
| 30 | -5 | 5 |
| 31 | -5 | -3 |
| 32 | -3 | -1 |

FIG. 30

LOW-PROFILE SPRING-LOADED CONTACTS

CROSS-REFERENCES TO RELATED APPLICATIONS

This application is a continuation-in-part of U.S. patent application Ser. No. 15/894,321, filed Feb. 12, 2018, which is a continuation of U.S. patent application Ser. No. 15/138,224, filed Apr. 26, 2016, which is a nonprovisional of U.S. provisional patent application No. 62/215,592, filed Sep. 8, 2015, which are incorporated by reference.

BACKGROUND

The number of types of electronic devices that are commercially available has increased tremendously the past few years and the rate of introduction of new devices shows no signs of abating. Devices such as tablets, laptops, netbooks, desktops, all-in-one computers, smart phones, storage devices, portable media players, wearable computing devices, navigation systems, monitors, and others, have become ubiquitous.

These electronic devices often include one or more connector receptacles through which they may provide and receive power and data. Power and data may be conveyed over cables that include a connector insert at each end of a cable. The connector inserts may be inserted into receptacles in the communicating electronic devices. In other electronic systems, contacts on a surface of first device may be in direct contact with contacts on a second device without the need for an intervening cable.

In systems where contacts on two electronic devices come into direct contact with each other, it may be difficult to generate enough normal force to ensure a good electrical connection between contacts in the two devices. To provide a sufficient normal force, contacts may often have a substantial depth and consume a relatively large volume of space in the electronic device. The loss of this space may mean that the electronic device is either larger or only includes a reduced set of functionality.

These electronic devices may be manufactured in large numbers. A corresponding number of contact structures may be manufactured for use in these devices. Any simplification in the manufacturing process of these contact structures may yield tremendous savings in the manufacturing of these electronic devices.

Thus, what is needed are contact structures that provide a sufficient normal force while consuming a minimal amount of surface area, depth, and volume in an electronic device and are readily manufactured.

SUMMARY

Accordingly, embodiments of the present invention may provide contact structures that provide a sufficient normal force while consuming a minimal amount of surface area, depth, and volume in an electronic device and are readily manufactured.

An illustrative embodiment of the present invention may provide contact structures having movable contacts at a surface of an electronic device. The contact structures may include a nonconductive housing supporting one, two, three, or more conductive contacts. Each contact may have a contacting portion that may be located at an end of a flexible lever arm, where a remote end of the flexible lever arm may be fixed to the housing. The contacts may have contacting portions that emerge from corresponding openings in the housing.

These contact structures may be manufactured in various ways. For example, the contacting portions may be attached to ends of the flexible lever arms by riveting, soldering, or the contacting portions and the flexible lever arms may be formed as a single piece. The contacting portions may be formed of the same or different materials. For example, the contacting portions may be formed of a material that provides a low resistance and low corrosion, while the flexible lever arms may be formed of a material chosen for its flexibility and its ability to withstand fatigue and cold-working. The contacting portion may have a narrowed tail extending from a wider body, where the narrowed tail may be inserted into an opening at an end of the flexible lever arm. The narrowed tail may extend through and beyond the flexible lever arm. Force may be applied to the narrowed tail causing it to expand outward, for example in a riveting process. The contacting portion may be held in place in the opening on the flexible lever arm on one side by the expanded narrowed tail and on the other side by the wider body. Each flexible lever arm may have a surface-mount contacting portion at an end remote from the contacting portion. Each flexible lever arm may further include a barb to be inserted into a notch or groove in the contact structure housing. In other embodiments of the present invention, one or more contacts, such as the center contact, may have the housing insert molded around it such that it does not require a barb. The contacts may be arranged in a line in the housing, though they may be arranged in other patterns. Contacts that are centrally located in the housing may be inserted into the housing from a bottom side and fixed in place by inserting their barbs into slots or grooves in the housing. Again, in other embodiments of the present invention these center contacts may have the housing insert molded around it. Support structures may be placed under the contacting portions of the central and other contacts to limit their travel such that they cannot be pushed all the way into the housing, though these may not be needed when the housing is insert molded around the center contact. Contacts located at the ends may be slid into the housing using slots in the housing. The side contacts may also be fixed in place by inserting their barbs into slots or grooves in the housing. Insulating tape may be used to electrically insulate the housing. A cover having openings for the contacting portions may be fit over the housing. The cover may have a raised portion around the openings for the contacts to fit in an opening of a device enclosure of the electronic device housing the contact structure.

Another illustrative embodiment of the present invention may provide contact structures that may provide movable contacts at a surface of an electronic device. The contact structures may include a nonconductive housing having slots for a number of conductive contacts. Each contact may include a contacting portion attached to a flexible lever arm. The flexible lever arm may attach to a contact length that may be located in a slot in the housing. A cover may fit over the housing. The cover may include one or more raised portions having a one or more openings, each opening for a corresponding contacting portion of a contact. The openings may be located in the raised portion. The raised portion may fit in an opening of a device enclosure of the electronic device housing the contact structure. The contact structure may further include a bottom plate. The bottom plate may include side tabs that fit in notches or slots in sides of the housing and cover to fix the cover and housing in place relative to the bottom plate.

Another illustrative embodiment of the present invention may provide contact structures that have movable contacts at a surface of an electronic device. This contact structure may include a nonconductive housing supporting one, two, three, or more conductive contacts. Each contact may be a spring-biased contact. The spring-biased contacts may have contacting portions that emerge from corresponding openings in the housing.

These contact structures may be manufactured in various ways. For example, the spring-biased contacts may be attached to a flexible circuit board. Terminal contacts on the spring-biased contacts may be soldered into opening in the flexible circuit board. A layer of double-sided adhesive may be used to fix the flexible circuit board to a bracket. Threaded inserts may be placed in one or more openings in the bracket, or the ends of the brackets may include threaded openings. For example, the threaded inserts may be press-fit into openings near ends of the bracket. A cap may be formed where the cap may include openings for contacting portions of the spring-biased contacts. The openings may be located on a raised portion that may be arranged to fit in an opening of a device enclosure of the electronic device housing the contact structure. The cap may include gaskets that form rings around the contacting portions of the spring-biased contacts between the contacting portions and inside edges of the openings in the raised portion of the cap. The cap may be formed as a double-shot injection molded part where the gaskets are the second injection-molded shot. The cap may be fixed to the flexible circuit board using a double-sided adhesive layer. A lid, which may be part of a device enclosure for the device housing the contact structure, may be fixed over the top of the contact structure by screws or other fasteners that may be fit into openings in the lid and inserted into the threaded inserts. The raised portion of the cap may fit into a central opening in the lid. A gasket may be placed around the raised portion of the cap and between the cap and the lid to prevent the ingress of liquid, moisture, debris, or other substances into the electronic device housing the contact structure.

The spring-biased contacts may be formed in various ways. For example, a housing have a central hole may be provided. A spring may be fit into the central hole. A contacting portion having a backside opening may be fit over the spring such that one end of the spring is in the central hole of the housing and the other end of the spring is in the backside opening of the contacting portion. A terminal structure may be fit over the contacting portion and top of the housing. A tab on the contacting portion may be under the terminal structure such that the contacting portion is held in place. Tabs on the terminal structure may fit in notches or slots in the housing to secure the terminal structure in place relative to the housing. The terminal structure may include through-hole portions that may be inserted and soldered in place in openings in the flexible circuit board.

Another illustrative embodiment of the present invention may provide contact structures that may provide movable contacts at a surface of an electronic device. The contact structures may include a nonconductive housing having slots for a number of conductive contacts. Each contact may include a contacting portion attached to a flexible lever arm. The flexible lever arm may attach to a contact length that may be located in a slot in the housing. The housing may include a number of raised portions, each having an opening, each opening for a corresponding contacting portion of a contact. The raised portions may fit in openings of a device enclosure of the electronic device that includes the contact structure. The contact structure may further include a bottom plate. The bottom plate may be attached to the housing by a first adhesive layer. A second adhesive layer may hold the contact structure in place against an inside surface of the device enclosure.

Contacts on a surface of a device may be in highly visible location. As such, embodiments of the present invention may provide methods of coating the contacts to have a specific color. The color may be selected to match a color of a portion of a device enclosure for the electronic device housing the contacts. For example, the color of the contacts may be chosen to match a portion of the device enclosure that surrounds or is near the contacts. This may provide an electronic device where the contacts and at least a portion of the device enclosure appear to be made of the same material. This uniform appearance may enhance the perceived quality and value of the electronic device.

These and other embodiments of the present invention may instead provide methods of coating contacts to provide a color to contrast with a color of a portion of a device enclosure for the electronic device housing the contacts. This color may be a noticeable color that allows a user to quickly find the contacts for mating with contacts of a second or accessory device. This contrasting color may also be chosen to imply a manufacturing source, or to match other electronic devices, such as a second or accessory device.

In these and other embodiments of the present invention, the contacts may have a specific finish, such as a matte or gloss finish. The color may also have a level of transparency. The contacts may also have more than one color. For example, a logo or other fanciful, identifying, or other information may be conveyed by more than one color on a contact.

These and other embodiments of the present invention may provide electrical contacts having a low contact resistance. For example, these contacts may have a textured surface having patterns of raised areas or ridges. These raised areas or ridges may provide a large number of contacting points between the contacts and corresponding contacts on a second or accessory device when the contacts are mated with the corresponding contacts.

These and other embodiments of the present invention may provide electrical contacts having good corrosion and scratch resistance. For example, a coating to provide color may be placed over a surface of the contact and this additional coating may provide an amount of protection for the contact against corrosion or scratches.

These and other embodiments of the present invention may provide contacts having a layer of a silicon based polymer. The silicon based polymer may be dyed to have a specific color, for example a color to match or contrast with at least a portion of an electronic device housing the contacts. Unfortunately, a silicon-based polymer may be a poor conductor. Accordingly, embodiments of the present invention may use this coating only over a portion of a surface of a contact, while the remainder of the surface of the contact may be used to form electrical connections with corresponding contacts on corresponding connectors or devices. In these and other embodiments of the present invention, instead of a silicon-based polymer, a germanium-based polymer may be used.

More specifically, in these and other embodiments of the present invention, a plurality of holes may be formed in at least a portion a surface of a contact. These holes may leave a pattern of raised areas or ridges on the surface of the contact. One or more layers may be plated or otherwise formed on at least a portion of the surface of the contact. A layer of silicon-based polymer may be applied as a gel to at least a portion of the surface of the contact. A solvent may then optionally be sprayed or otherwise applied to the gel. The silicon based polymer may be cured such that it contracts into the holes leaving the raised areas or ridges exposed. The optional solvent may help to remove water from the gel during curing to avoid cracking. The exposed areas or ridges may form electrical pathways with a corresponding contact on a corresponding connector or device when the contact and the corresponding contact are mated.

In these and other embodiments of the present invention, the holes may be formed in various ways. A substrate of the contact may be formed of copper, copper alloy, or other material. The holes in a surface of a contact may be formed by sandblasting, chemical etching, photolithography, laser etching, stamping, coining, 3-D printing, metal-injection molding, printing, casting, or they may be formed in other ways. To avoid the appearance of lines or other artifacts in the pattern of holes, such as light or dark patches, the location of the holes may be varied or randomized. For example, a laser may have a portion of its position information for some or all of the holes varied or randomized in order to disperse straight lines or other regular or repeating patterns that might otherwise be visible. In these and other embodiments of the present invention, in order to avoid the appearance of lines, light or dark patches, or other artifacts, the depths of the holes may be varied or randomized. In these and other embodiments of the present invention, the diameter of the holes may be varied or randomized. Also, holes may be omitted from areas or regions on contacts where such holes may interfere with the assembly or operation of the contacts. For example, where contacts are located in an injection molded housing, holes may be omitted from areas or regions that are under or near the injection molded housing.

In these and other embodiments of the present invention, the holes may have various sizes and spacings. For example, the diameter of the holes may be less than 20 microns, 20-40 microns, 40 microns, 42 microns, 40-45 microns, 45 microns, 48 microns, 55 microns, 52-58 microns, or more than 60 microns. The holes may have a depth of less than 5 microns, 5-10 microns, 8 microns, 10 microns, 10-30 microns, 12 microns, 13 microns, 15 microns, 20 microns, 20-25 microns, or more than 25 microns. The holes may have a center-to-center pitch of less than 20 microns, 20-50 microns, 40 microns, 50 microns, 30-60 microns, 50 microns, 60 microns, 70 microns, 50-70 microns, or more than 70 microns. The holes may have a spacing of less than 5 microns, 5-10 microns, 10 microns, 20 microns, 10-20 microns, 15 microns, 20 microns, 25 microns, 15-25 microns, or more than 25 microns. The spacing or center-to-center pitch of the holes may be varied or randomized to avoid visible patterns formed by the holes. For example, the X and Y coordinates of the holes may be varied in a range such as a plus or minus 3, 4, 5, or more than 5 micron range. These values may be stored in a table and used to modify target information for a laser forming the holes. Light and dark spots may be reduced or removed by adjusting values in the table.

After the holes have been formed, one or more plating layers may be applied to the surface of the contact. For example, a top plate may be formed over the contact to provide corrosion and scratch protection. This top plate may be formed of rhodium ruthenium or other material. A barrier layer may be formed over the contact before the top plate is formed to prevent discoloration of the top plate by the copper substrate. The barrier layer may be tin-copper, nickel, palladium, silver, tin-copper-nickel, copper-nickel, tin-nickel, nickel-tungsten, electroless nickel, or other material. One or more adhesion layers may be applied before or after the barrier layer, or both. These adhesion layers may be a gold flash or other layer. Other layers may also be included. For example, a layer of nickel-tungsten alloy, tin-nickel, electroless nickel, copper-nickel, silver, or other material may be plated or formed over the substrate before the barrier layer. Other combinations, such as a top plate of rhodium ruthenium over silver, palladium, nickel, electroless nickel, a nickel-tungsten alloy, tin-nickel, tin-copper, tin-copper-nickel, copper-nickel, tin-nickel, nickel-tungsten, or other nickel alloy may be used, where one or more gold layers may be included. Layers of gold over nickel may also be used in these and other embodiments of the present invention. Additional steps, such as electro-polishing or copper plating may be performed on the substrate after the holes have been formed and before further plating to smooth areas damaged by the laser. In these and other embodiments of the present invention, these layers may be formed by sputtering, vapor deposition, electroplating, or other method. In these and other embodiments of the present invention, the order of these steps may be varied. For example, a substrate may be plated before holes are formed.

A dyed silicon-based polymer may then be applied as a gelatinous or viscous solution to one or more surfaces of the contact. The dyed silicon-based polymer may be a sol-gel, formed using a sol-gel process such as the Stöber process. In these and other embodiments of the present invention, tetraethyl orthosilicate (TEOS) may be hydrolyzed to form a silicon oxide network, which may be more generally referred to as sol-gel. In these and other embodiments of the present invention, instead of hydrolyzing, a similar process using a solvent may be employed. The sol-gel may be dyed and applied to one or more surfaces of the contact. A solvent may be applied to the sol-gel. In these and other embodiments of the present invention, both the sol-gel and the solvent may be applied by spraying, printing, or other method. After the sol-gel and optional solvent have been applied, the result may be cured. After curing, the sol-gel may contract to fill the holes, again leaving the surrounding raised portions and ridges exposed. These surrounding raised portions and ridges may then form an electrical connection with a corresponding contact when the contact and the corresponding contact are mated.

The sol-gel coated contacts may be cured or dried at room or a higher temperature. The die particles in the sol-gel may begin to aggregate as the sol-gel is cured or dried. As the curing process continues, the sol-gel may become more gelatinous and the aggregations of dyed particles may begin to themselves aggregate. The sol-gel may then become a solid as it contracts into the holes and pulls back from the raised portions and ridges. The optional solvent may help to prevent cracking and other damage to the sol-gel by removing water from the sol-gel during curing. The dried sol-gel may consume as little as eight percent of the original volume of the sol-gel.

In these and other embodiments of the present invention, instead of using a sol-gel, other materials, such as conductive ink or other types of ink may be used. In these and other embodiments of the present invention, paint may be used. For example, a polymeric paint, such as a polytetrafluoroethylene (PTFE) based paint, may be used. These inks or paints may be applied using pad printing, ink-jet printing, 3-D printing, aerosol jet printing, or other types of printing. In these and other embodiments of the present invention, the formation of holes may be optional.

Embodiments of the present invention may provide contact structures that may be located in various types of devices, such as portable computing devices, tablet computers, desktop computers, laptops, all-in-one computers, wearable computing devices, cell phones, smart phones, media phones, storage devices, keyboards, covers, cases, portable media players, navigation systems, monitors, power supplies, adapters, remote control devices, chargers, and other devices. These contact structures may provide pathways for signals and power compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In one example, the contact structures may be used to convey a data signal, a power supply, and ground. In various embodiments of the present invention, the data signal may be unidirectional or bidirectional and the power supply may be unidirectional or bidirectional.

Various embodiments of the present invention may incorporate one or more of these and the other features described herein. A better understanding of the nature and advantages of the present invention may be gained by reference to the following detailed description and the accompanying drawings.

BRIEF DESCRIPTION OF THE DRAWINGS

FIGS. 23-31 illustrate methods of manufacturing contacts according to embodiments of the present invention.

DESCRIPTION OF EXEMPLARY EMBODIMENTS

Figure 1:
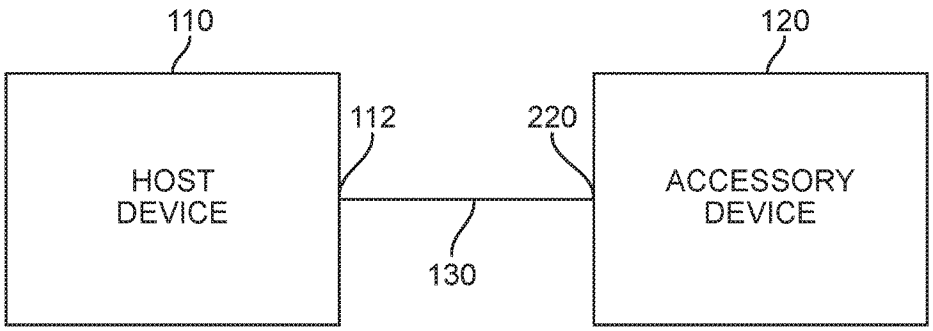
FIG. 1 illustrates an electronic system according to an embodiment of the present invention.

FIG. 1 illustrates an electronic system according to an embodiment of the present invention. This figure, as with the other included figures, is shown for illustrative purposes and does not limit either the possible embodiments of the present invention or the claims.

In this example, host device 110 may be connected to accessory device 120 in order to share data, power, or both. Specifically, contacts 112 on host device 110 may be electrically connected to contacts 220 on accessory device 120. Contacts 112 on host device 110 may be electrically connected to contacts 220 on accessory device 120 via cable 130. In other embodiments of the present invention, contacts 112 on host device 110 may be directly and electrically connected to contacts 220 on accessory device 120.

To facilitate a direction connection between contacts 112 on host device 110 and contacts 220 on accessory device 120, contacts 220 may be part of a surface-mount contact structure. An example of a surface-mount contact structure that may include contacts 220 is shown in the following figures.

Figure 2:
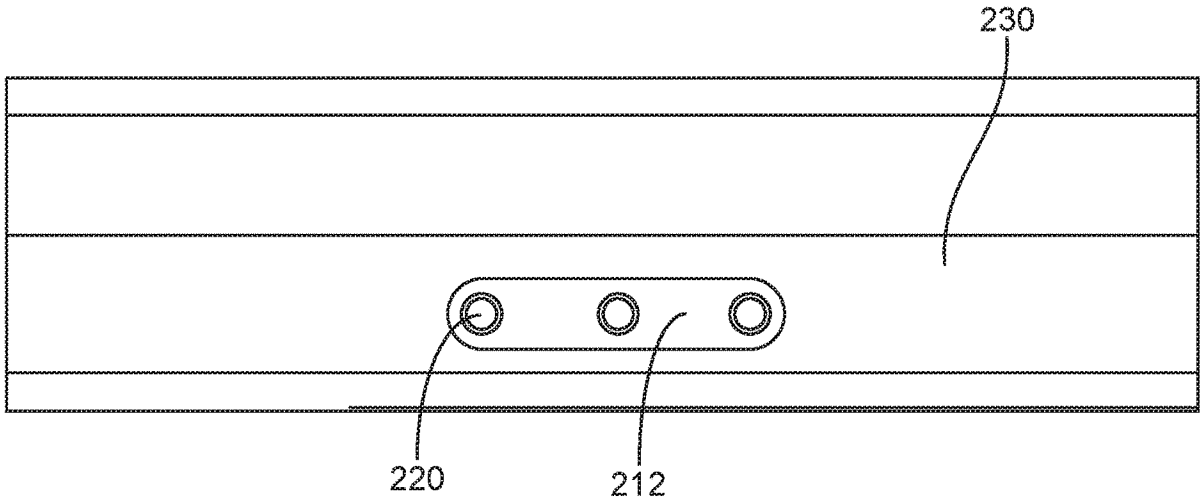
FIG. 2 illustrates a contact structure in a device enclosure according to an embodiment of the present invention.

FIG. 2 illustrates a contact structure in a device enclosure according to an embodiment of the present invention. In this example, a raised portion 212 of a contact structure may be placed in an opening in device enclosure 230. The raised portion 212 of the contact structure may include openings for a number of contacts 220.

Contacts 220 may be low-profile contacts. Such contacts may allow a contact structure to provide contacts for a connector without consuming a large volume in the electronic device housed by device enclosure 230. In various embodiments the present invention, contacts 220 may be spring-biased contacts. For example, contacts 220 may be biased by a spring, flexible arm, or other flexible structure such that they may be pushed or depressed and may return to their original position once released. Spring-biased contacts may provide an amount of compliance with contacts in a corresponding connector, thereby assisting in forming electrical connections between multiple contacts 220 and corresponding contacts of a second connector on a second device (not shown.)

Accordingly, embodiments of the present invention may provide contact structures having low-profile, spring-biased contacts. An example is shown in the following figure.

Figure 3:
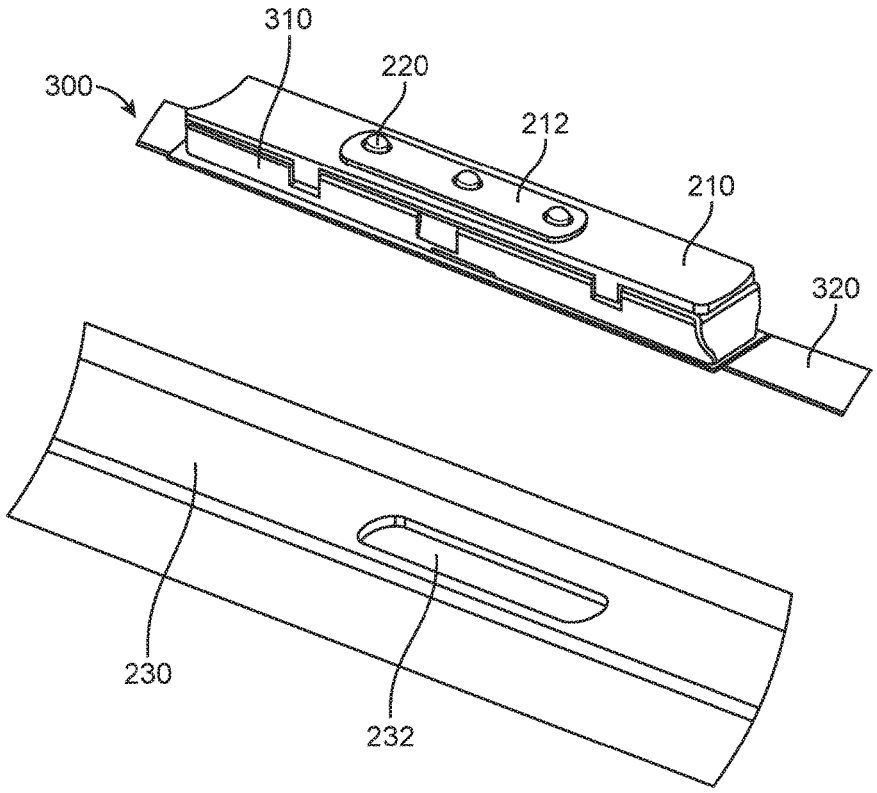
FIG. 3 illustrates a portion of an electronic device according to an embodiment of the present invention.

FIG. 3 illustrates a portion of an electronic device according to an embodiment of the present invention. This figure illustrates a contact structure 300 having a raised portion 212 on a cover 210 that is fit on a top side of housing 310. Raised portion 212 may be arranged to fit an opening 232 in device enclosure 230. Contact structure 300 and may support a number of contacts 220 each in openings in raised portion 212. Contacts 220 may emerge from bottom of housing 310 and be connected to interconnect 320.

In this example, contact structure 300 may include three contacts 220. In other embodiments of the present invention, contact structure 300 may include one, two, or more than three contacts 220. Also, while in this example each of the contacts 220 are located in a single raised portion 212, in other embodiments of the present invention, more than one raised portion 212 may be employed, and one or more contact 220 may be located in portions of contact structure 300 other than the one or more raised portions 212. Also, while the three contacts 220 are shown as being in a line, in other embodiments of the present invention, contacts 220 may be arranged in other patterns.

Figure 4:
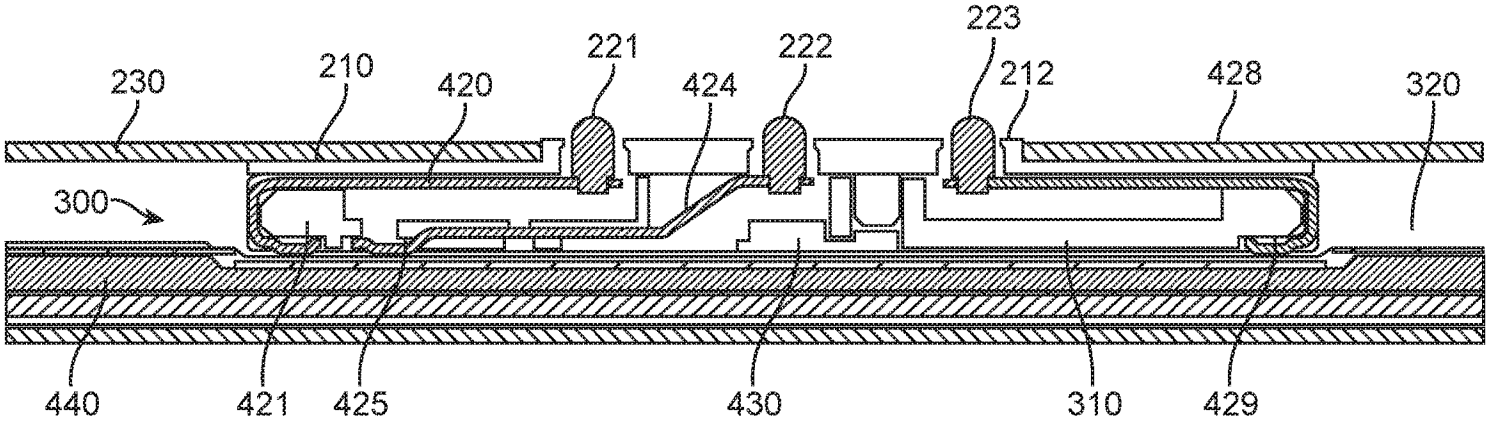
FIG. 4 illustrates a side view of a contact structure according to an embodiment of the present invention.

FIG. 4 illustrates a side view of a contact structure according to an embodiment of the present invention. Contact structure 300 may be located in an electronic device having device enclosure 230. As before, raised portion 212 of cover 210 of contact structure 300 may be located in an opening in device enclosure 230. Housing 310 of contact structure 300 may support contacts having contacting portions 221, 222, and 223. These contacting portions 221, 222, and 223 may be attached to ends of flexible lever arms 420, 424, and 428. Each flexible arm may terminate in a second end and may include a barb, which may be inserted into notches or grooves in housing 310. Specifically, flexible lever arm 420 may include barb 421, flexible lever arm 424 may include barb 425, and flexible lever arm 428 may include barb 429. In other embodiments of the present invention, the center contact may have housing 310 insert molded around it and barb 425 may not be needed.

During assembly, the central contact including contact portion 222 may be inserted through an opening in a bottom of housing 310. Without more, contacting portion 222 could be pushed deep into housing 310. In some instances, contacting portion 222 could be pushed below cover 210. If contacting portion 222 were to be laterally offset at this time, contacting portion 222 may not emerge from its opening in cover 210. Accordingly, a bottom stop portion 430 may be located under contacting portion 222. Bottom stop portion 430 may limit a depth to which contacting portion 222 may be depressed, thereby preventing possible damage to contact structure 300. In other embodiments of the present invention, the center contact may have housing 310 insert molded around it such that bottom stop portion 430 may not be needed.

Contacts structure 300 may be formed in various ways. An example is shown in the following figure.

Figure 5:
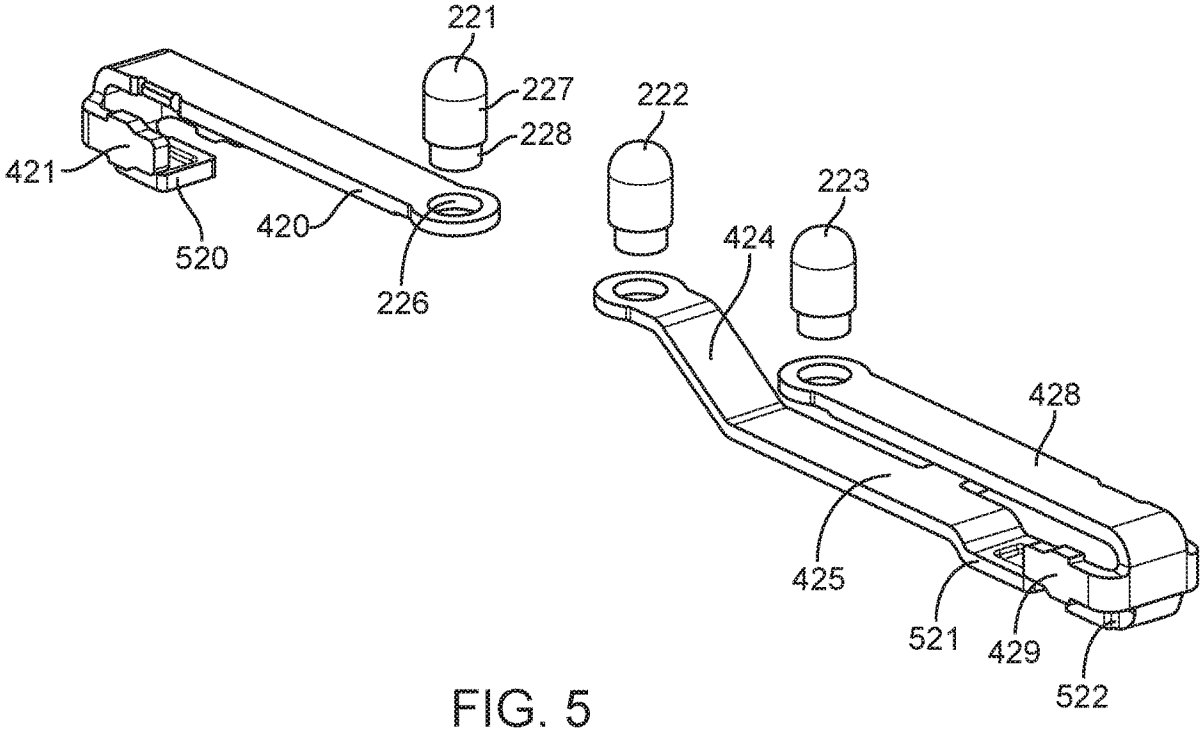
FIGS. 5-11 illustrate a method of assembling a contact structure according to an embodiment of the present invention.

FIGS. 5-11 illustrate a method of assembling a contact structure according to an embodiment of the present invention. In FIG. 5, contacts for a contact structure according to an embodiment of the present invention, such as contact structure 300, may be formed. These contacts may include contacting portions 221, 222, and 223. Ends of contacting portions 221, 222, and 223 may be attached to flexible lever arms 420, 424, and 428. Flexible lever arm 420 may terminate in a first barb 421 and include a surface-mount contact portion 520. Flexible lever arm 424 may include barb 425 and may terminate in surface-mount contacting portion 521. Flexible lever arm 428 may include barb 429 and may terminate in surface-mount contacting portion 522. In other embodiments of the present invention, the center contact may have housing 310 insert molded around it and barb 425 may not be needed.

Contacting portions 221, 222, and 223 may be riveted to flexible lever arms 420, 424, and 428. Specifically, contacting portion 221 may include a narrowed tail portion 228 below ledge 227. Narrowed end or tail portion 228 may be inserted into opening 236 in flexible lever arm 420. Ledge 227 may rest on a top surface of flexible lever arm 420 around opening 226. Narrowed end or tail portion 228 may have a force applied such that it widens, for example, by riveting. In this way, contacting portion 221 may be secured to flexible lever arm 420 by ledge 427 and the widened portion of narrowed tail portion 228. When contacting structure 300 is mounted on a board or other appropriate substrate, surface-mount contacting portions 520, 521, and 522 may be soldered to contacts on the board thereby forming interconnect path from contacting portions 221, 222, and 223 to interconnect traces on the board.

Figure 6:
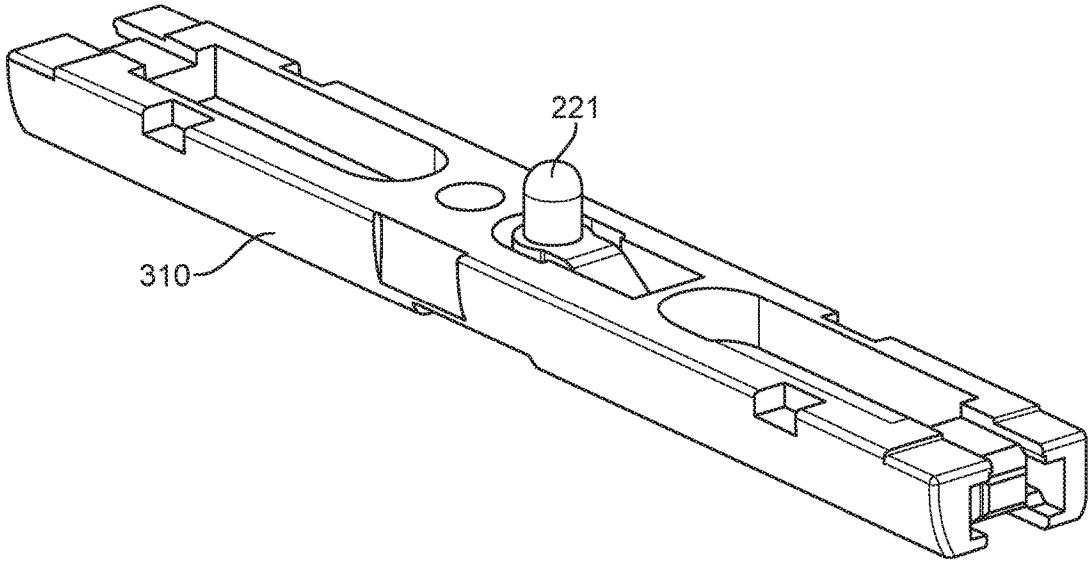

In FIG. 6, a central contact including contacting portion 221 may be inserted through an opening in a bottom of housing 310. At least some of contacting portion 221 may emerge from a top surface of housing 310. In other embodiments, housing 310 may be insert molded around the central contact.

Figure 7:
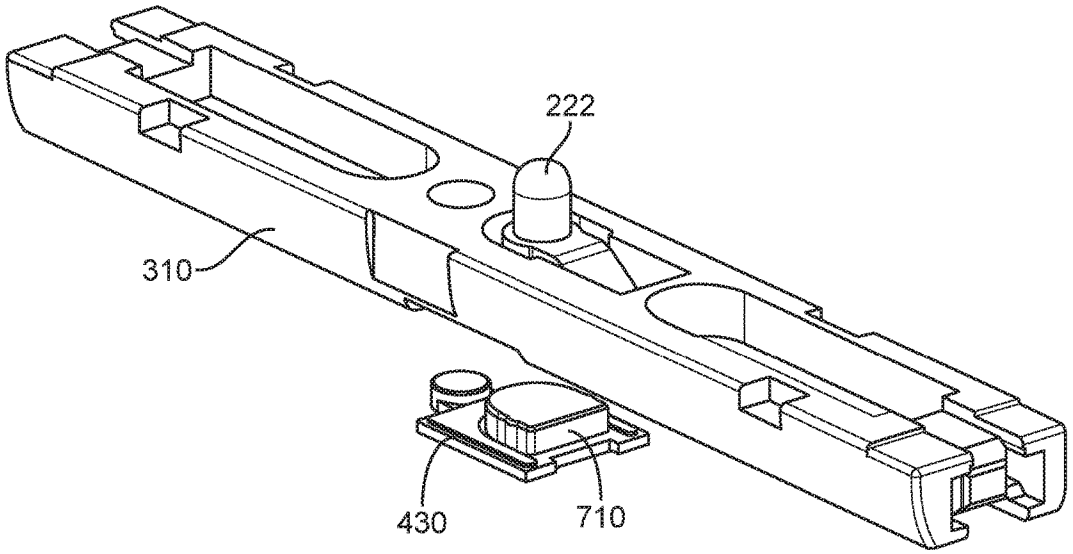

In FIG. 7, central contact 220 is inserted through a bottom opening in housing 310. Since central contact 220 is inserted through a bottom opening in housing 310, central contacting portion 221 could inadvertently be pushed all the way to the bottom of housing 310. To prevent this, embodiments of the present invention may attach a bottom stop portion 430 to a bottom of housing 310. Bottom stop portion 430 may include a raised portion 710 below contacting portion 221. This raised portion 710 may restrict the travel range of contacting portion 221. This may prevent contacting portion 221 be pushed all the way into housing 310, thereby damaging contacting structure 300. In other embodiments of the present invention, the center contact may have housing 310 insert molded around it and bottom stop portion 430 may not be needed.

Figure 8:
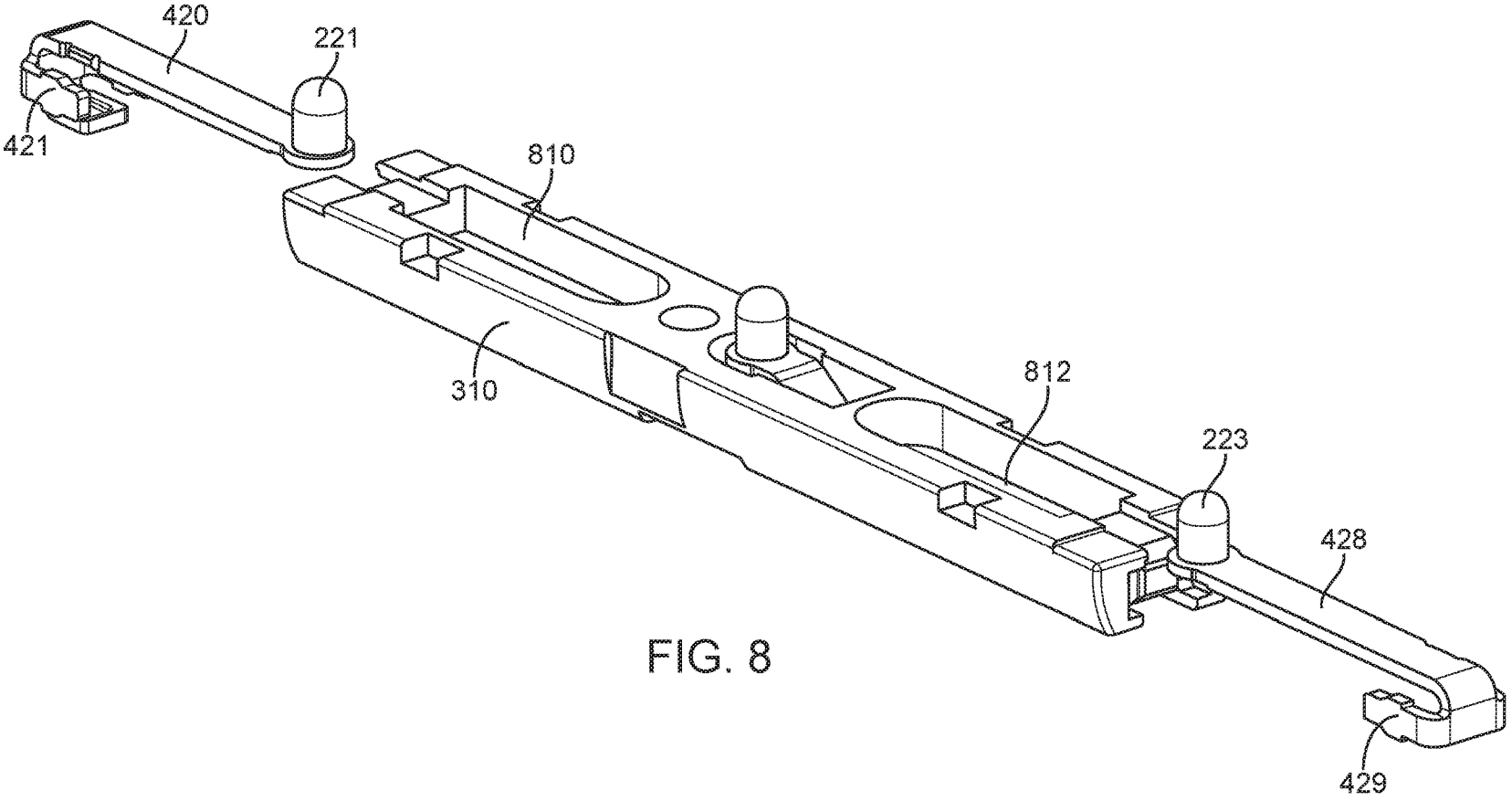

In FIG. 8, side contacts including contacting portions 221 and 223 may be inserted into housing 310 using slots 810 and 812. Flexible lever arm 420 may be pushed into housing 310 until barb 421 is inserted into a groove or notch in housing 310. Similarly, flexible lever arm 428 may be pushed into housing 310 until barb 429 is inserted into a groove or notch in housing 310.

Figure 9:
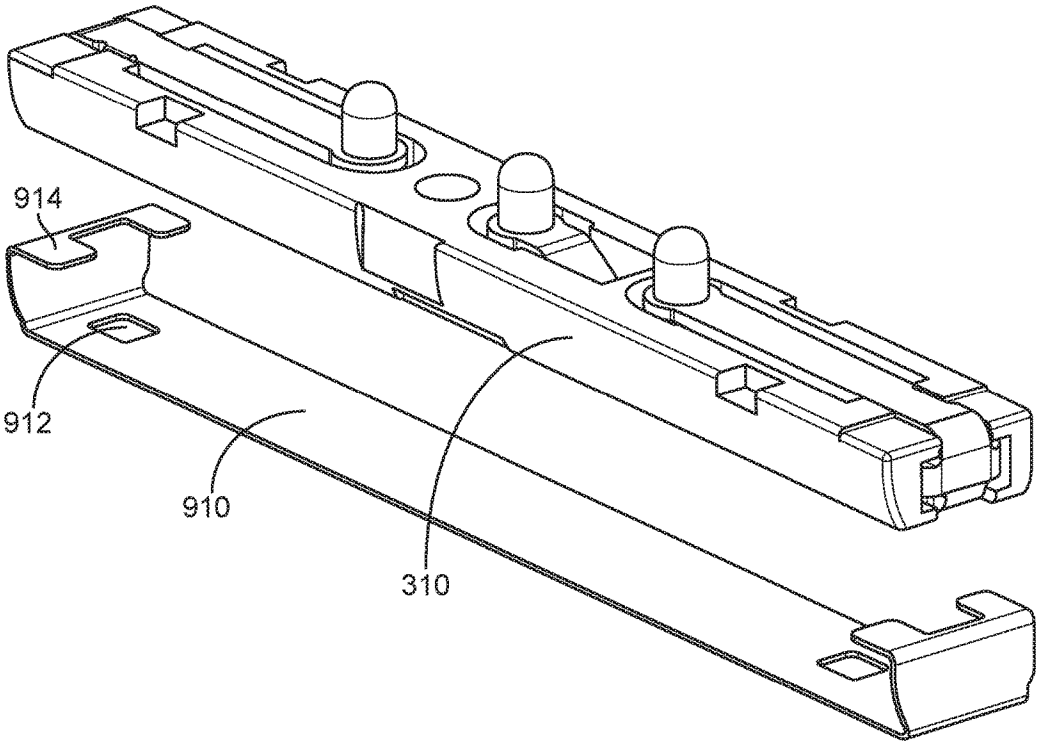

In FIG. 9, a piece of insulating tape 910 may be wrapped around a portion of the top, sides, and bottom of housing 310. Insulating tape 910 may include openings 912 for surface-mount contacting portions 520, 521, and 522 of the contacts in housing 310. Insulating tape 910 may include top surface tabs 914. Top surface tabs 914 may be sandwiched between cover 210 and housing 310, thereby helping to maintain insulating tape 910 in place. In various embodiments of the present invention, insulating tape 910 may be Mylar tape or other type of tape or insulating layer.

Figure 10:
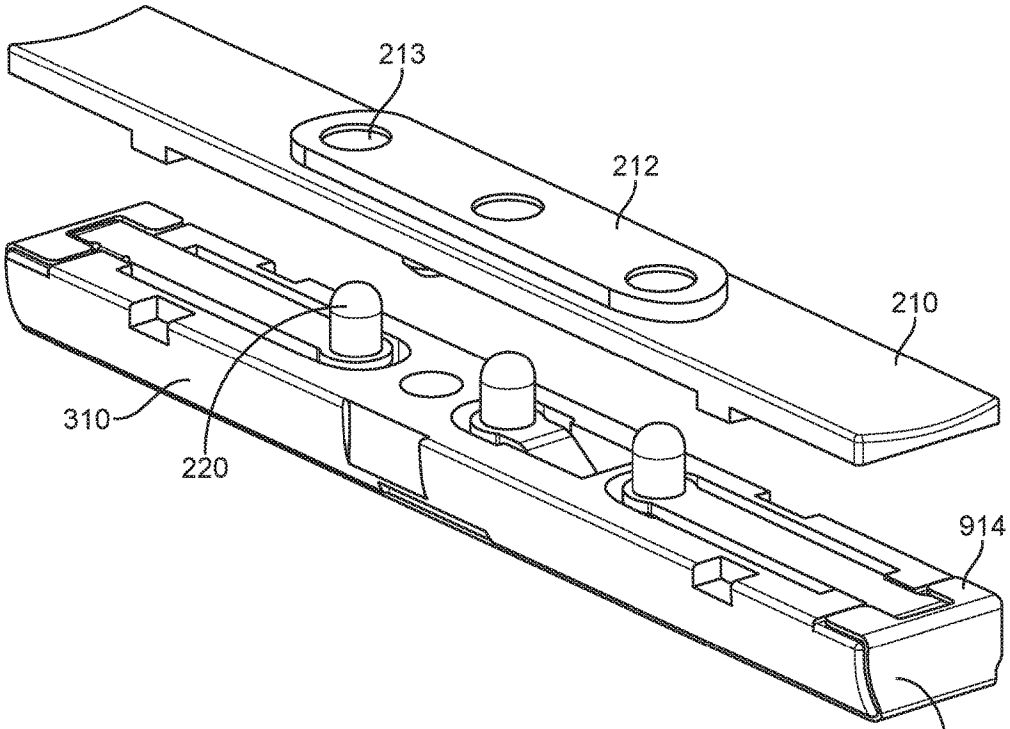

In FIG. 10, a cover 210 may be placed over housing 310. Again, top surface tabs 914 of insulating tape 910 may be placed between cover 210 and housing 310, thereby holding insulating tape 910 in place. Cover 210 may include a raised portion 212 having openings 213 for contacts 220.

Figure 11:
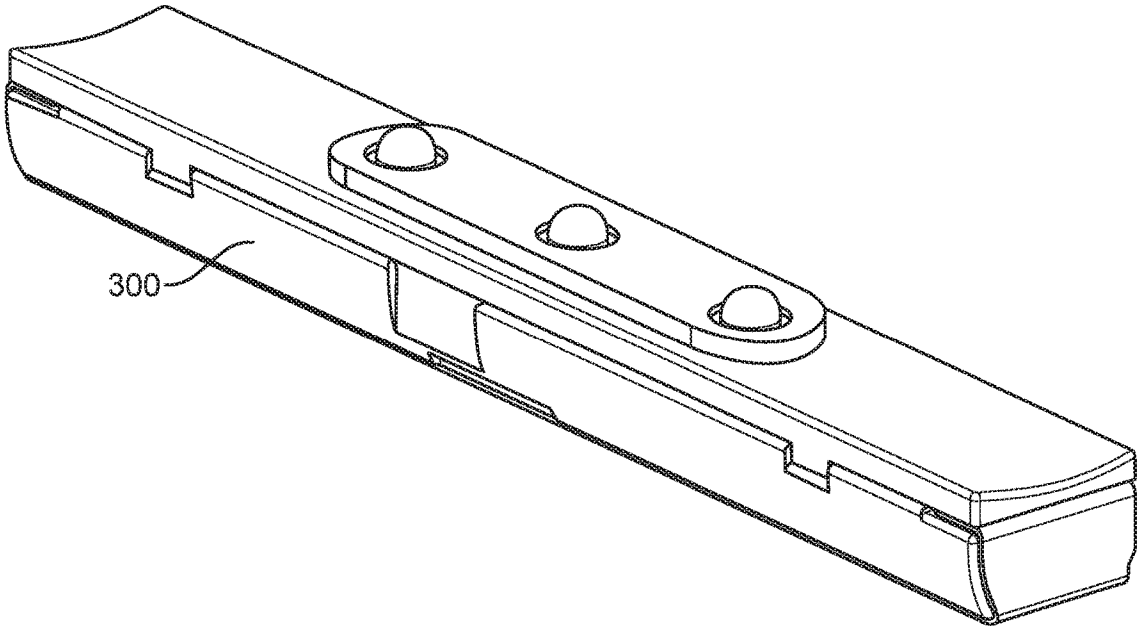

FIG. 11 illustrates a completed contact structure 300 according to an embodiment of the present invention.

In various embodiments of the present invention, different portions of contact structure 300 and other contact structures may be formed of various materials. For example, housing 310 and cover 210 may be formed of the same or different materials, such as plastic, LPS, or other non-conductive material. Contacting portions 221, 222, and 223, may be formed of noncorrosive materials, such as gold, gold plated copper, gold plated nickel, gold-nickel alloy, and other materials. Flexible lever arms 420, 444, and 428 may be formed of spring metal, sheet-metal, copper alloy, or other complaint material.

In various embodiments of the present invention, different portions of contact structure 300 and other contact structures may be formed in various ways. For example, housing 310 and cover 210 may be formed using injection or other molding, printing, or other technique. Contact portions 221, 222, and 223 and flexible lever arms 420, 424, and 428 may be machined, stamped, coined, forged, printed, or formed in different ways. Contact portions 221, 222, and 223 may be attached to flexible lever arms 420, 424, and 428 by riveting, soldering, spot-welding, or other technique, or they may be formed as a single unit. Housing 310 and cover 210 may be formed around contacts 220 using injection molding.

Figure 12:
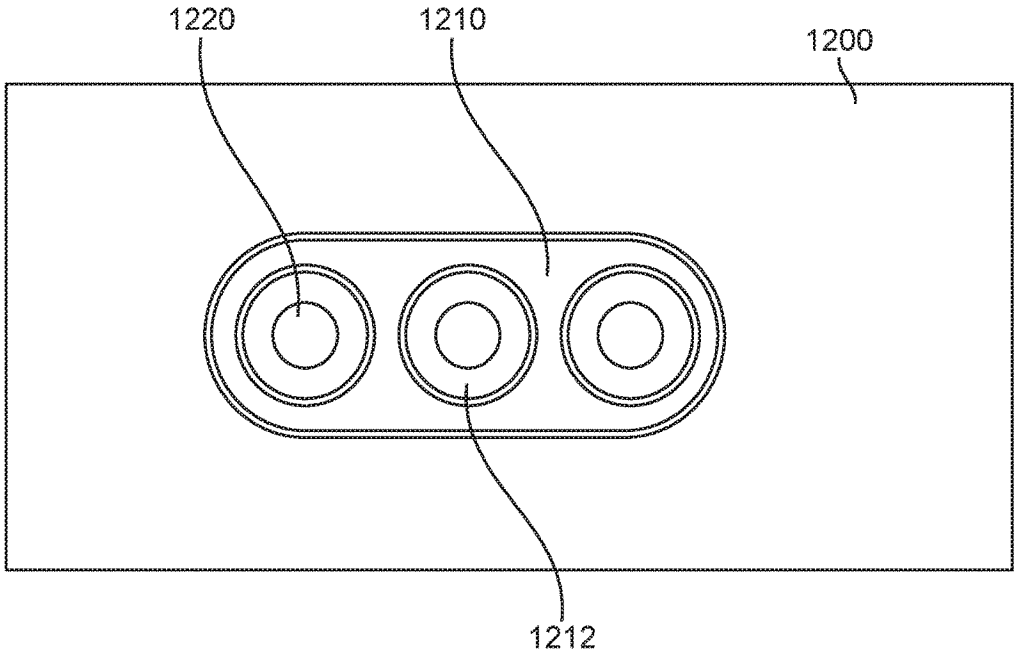
FIG. 12 illustrates another contact structure in a device enclosure according to an embodiment of the present invention.

FIG. 12 illustrates another contact structure in a device enclosure according to an embodiment of the present invention. In this example, a raised portion 1210 of a contact structure may be fit in an opening in device enclosure 1200. Raised portion 1210 may include contacting portions 1220 each surrounded by an individual raised portion 1212.

Contacting portions 1220 may be low-profile contacts. Such contacts may allow a contact structure to provide contacts for a connector without consuming a large volume in the electronic device housed by device enclosure 1200. In various embodiments the present invention, contacting portions 1220 may be contacting portions for spring-biased contacts. For example, contacting portions 1220 may be biased by a spring, flexible arm, or other flexible structure such that they may be pushed or depressed and may return to their original position once released. Spring-biased contacts may provide an amount of compliance with contacts in a corresponding connector, thereby assisting in forming electrical connections between multiple contacting portions 1220 and corresponding contacts of a second connector on a second device (not shown.)

Accordingly, embodiments of the present invention may provide contact structures having low-profile, spring-biased contacts. An example is shown in the following figure.

Figure 13:
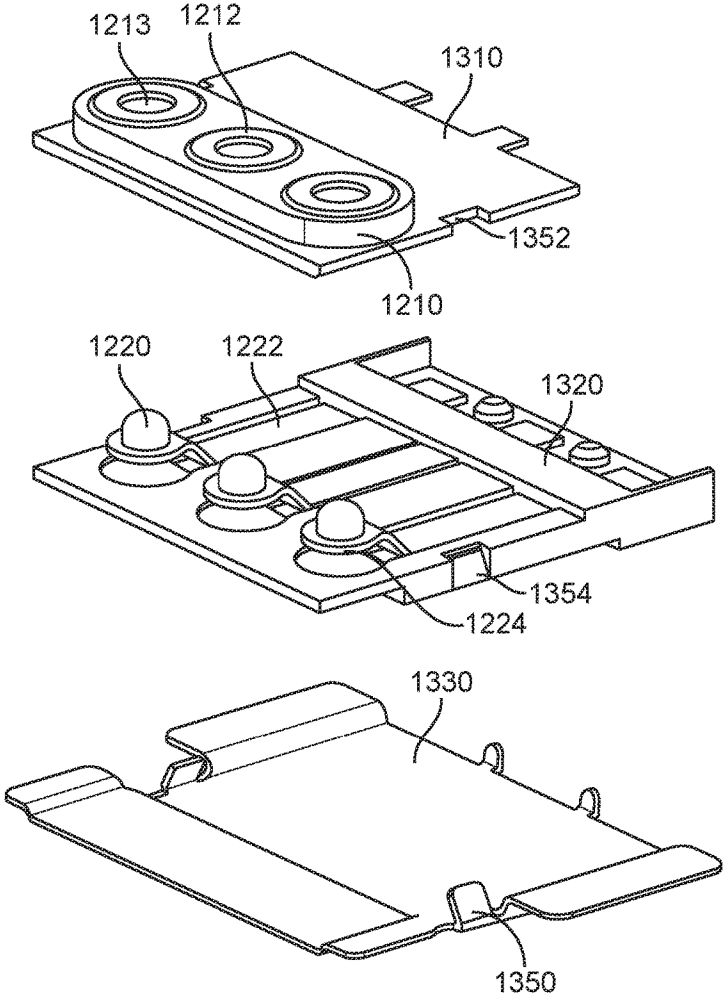
FIG. 13 illustrates a contact structure according to an embodiment of the present invention.

FIG. 13 illustrates a contact structure according to an embodiment of the present invention. This contact structure may include housing 1320 having a number of slots for contact portions 1222. Contact portions 1222 may connect to contacting portions 1220 via flexible lever arms 1224.

This contact structure may further include a top plate or cover 1310 having a raised portion 1210. Raised portion 1210 may include further raised portions 1212 around each opening 1213. Each opening 1213 may allow a connection to be made to contacting portion 1220.

This contact structure may further include a bottom plate 1330. Bottom plate 1330 may include tabs 1350 to fit in notch 1352 in top plate or cover 1310 and notch 1354 in housing 1320 to secure top plate or cover 1310, housing 1320, and bottom plate 1330 together as a unit.

In various embodiments of the present invention, different portions of this contact structure and other contact structures may be formed of various materials. For example, housing 1320, cover 1310, and bottom plate 1330 may be formed of the same or different materials, such as plastic, LPS, or other non-conductive material. Contacting portions 1220 may be formed of noncorrosive materials, such as gold, gold plated copper, gold plated nickel, gold-nickel alloy, and other materials. Flexible lever arms 1224 and contact portions 1222 may be formed of spring metal, sheet-metal, copper alloy, or other complaint material.

In various embodiments of the present invention, different portions of this contact structure and other contact structures may be formed in various ways. For example, housing 1320, cover 1310, and bottom plate 1330 may be formed using injection or other molding, printing, or other technique. Contacting portions 1220, flexible lever arms 1224, and contact portions 1222 may be machined, stamped, coined, forged, printed, or formed in different ways. Contact portions 1220 may be attached to flexible lever arms 1224 by riveting, soldering, spot-welding, or other technique, or they may be formed as a single unit. Housing 1320, cover 1310, and bottom plate 1330 may be formed around contacting portions 1220 using injection molding.

Figure 14:
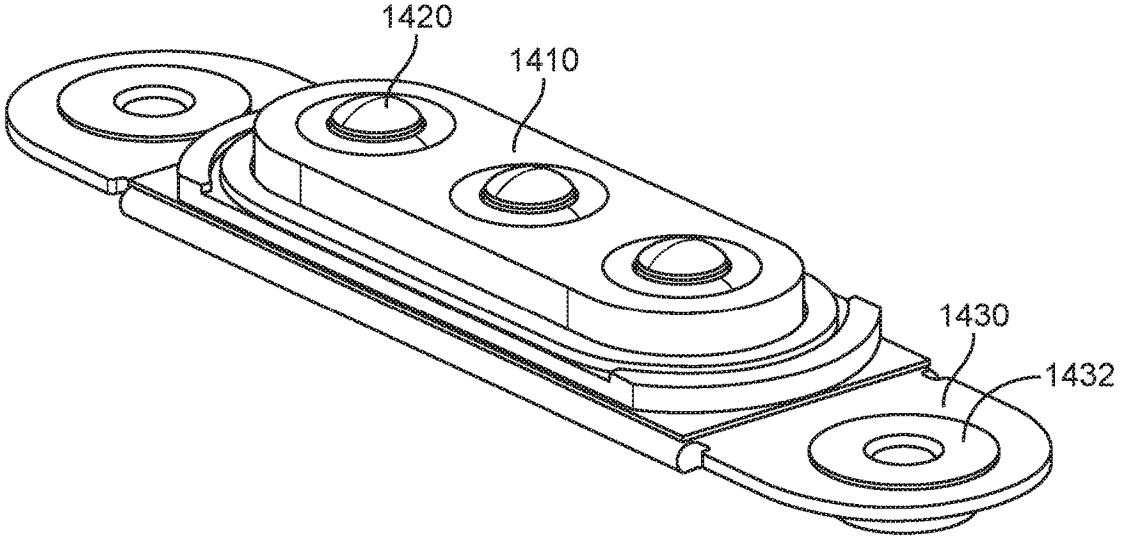
FIG. 14 illustrates a contact structure in a device enclosure according to an embodiment of the present invention.

FIG. 14 illustrates a contact structure in a device enclosure according to an embodiment of the present invention. In this example, a raised portion of a cap 1410 of a contact structure may be fit in an opening in a device enclosure. A raised portion of cap 1410 may include contacts 1420. This contact structure may include bracket 1430. Bracket 1430 may be fixed to a lid, device enclosure, or other structure by inserting fasteners into threaded inserts 1432.

Contacts 1420 may be low-profile contacts. Such contacts may allow a contact structure to provide contacts for a connector without consuming a great deal of volume in the electronic device housed by the enclosure. In various embodiments the present invention, contacts 1420 may be spring-biased contacts. For example, contacts 1420 may be biased by a spring, flexible arm, or other flexible structure such that they may be pushed or depressed and may return to their original position once released. Spring-biased contacts may provide an amount of compliance with contacts in a corresponding connector, thereby assisting in forming electrical connections between multiple contacts 1420 and corresponding contacts of a second connector on a second device (not shown.)

This contact structure may be assembled in various ways. An example is shown in the following figure.

Figure 15:
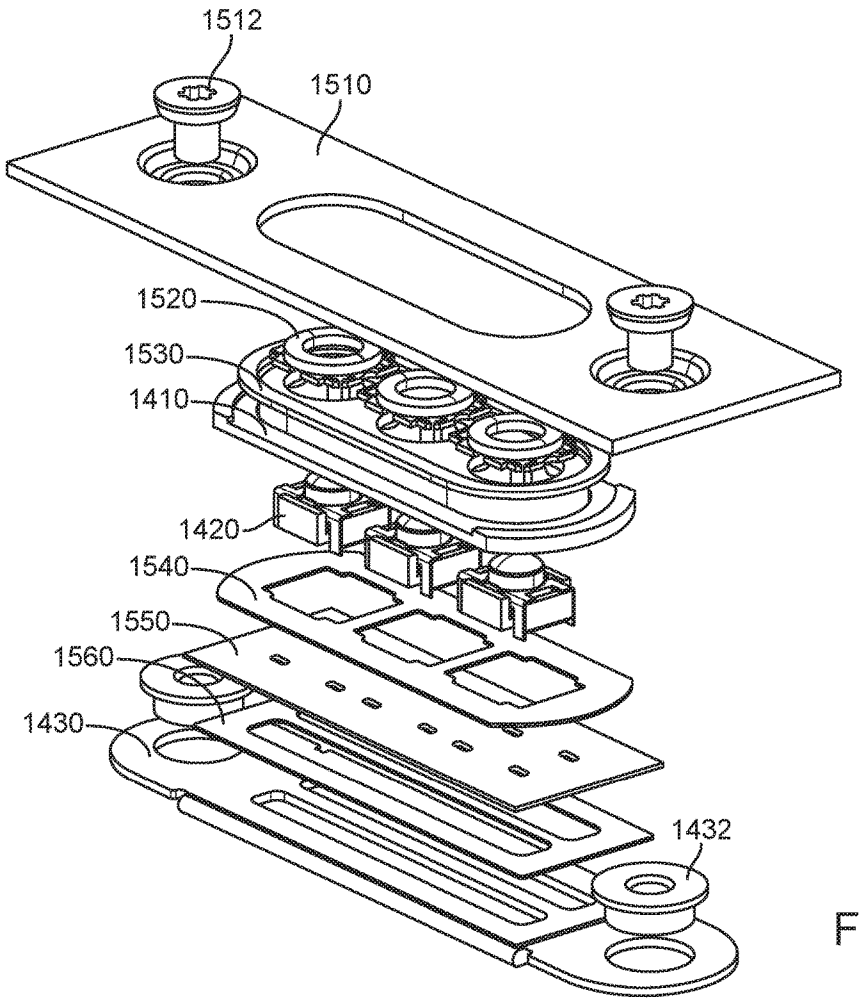
FIG. 15 is an exploded view of a contact structure according to an embodiment of the present invention.

FIG. 15 is an exploded view of a contact structure according to an embodiment of the present invention. In this example, a flexible circuit board 1550 may include a number of openings for terminals of spring-biased contacts 1420. Spring-biased contacts 1420 may be attached to flexible circuit board 1550 by inserting terminals of spring-biased contacts 1420 into the openings in flexible circuit board 1550 and soldering. A cap 1410 having openings for contacts 1420 may be placed over contacts 1420. Cap 1410 may further include gaskets 1520 in openings in cap 1410. An additional gasket 1530 may be placed or formed between contacts 1420 and inside edges of openings in cap 1410. Gaskets 1520 and 1530 may be formed of silicone or other sealing material. Cap 1410 may be formed as a two shot injection molded process, where the main part of cap 1410 is formed in a first shot and gaskets 1520 are formed in a second shot. Cap 1410 may be attached to flexible circuit board 1550 using a double-sided adhesive layer 1540. Adhesive layer 1540 may be a heat activated film or adhesive layer. Bracket 1430 may be attached using a second adhesive layer 1560 to a bottom of flexible circuit board 1550. Adhesive layer 1560 may also be a heat activated film or adhesive layer. Lid 1510 may be placed over cap 1410. Lid 1510 may be a portion of a device enclosure for a device housing this contact structure. The enclosure may be conducive or nonconductive. Gasket 1530 may be placed around a raised surface of cap 1410 and be located between cap 1410 and lid 1510. Threaded inserts 1432 may be press-fit into openings at ends of bracket 1430. Fasteners, such as screws 1512, may be inserted into openings at ends of lid 1510 and screwed into threaded inserts 1432 in bracket 1430. In other embodiments of the present invention, the threaded inserts may be replaced by threaded opening in bracket 1430.

In this example, the contact structure may include three contacts 1420. In other embodiments of the present invention, the contact structure may include one, two, or more than three contacts 1420. Also, while in this example each of the contacts 1420 are located in a single raised portion, in other embodiments of the present invention, more than one raised portion may be employed, and one or more contact 1420 may be located in portions of the contact structure other than the one or more raised portions. Also, while the three contacts 1420 are shown as being in a line, in other embodiments of the present invention, contacts 1420 may be arranged in other patterns.

Various spring-biased contacts 1420 may be used in contacting structures according to embodiments of the present invention. An example is shown in the following figures.

Figure 16:
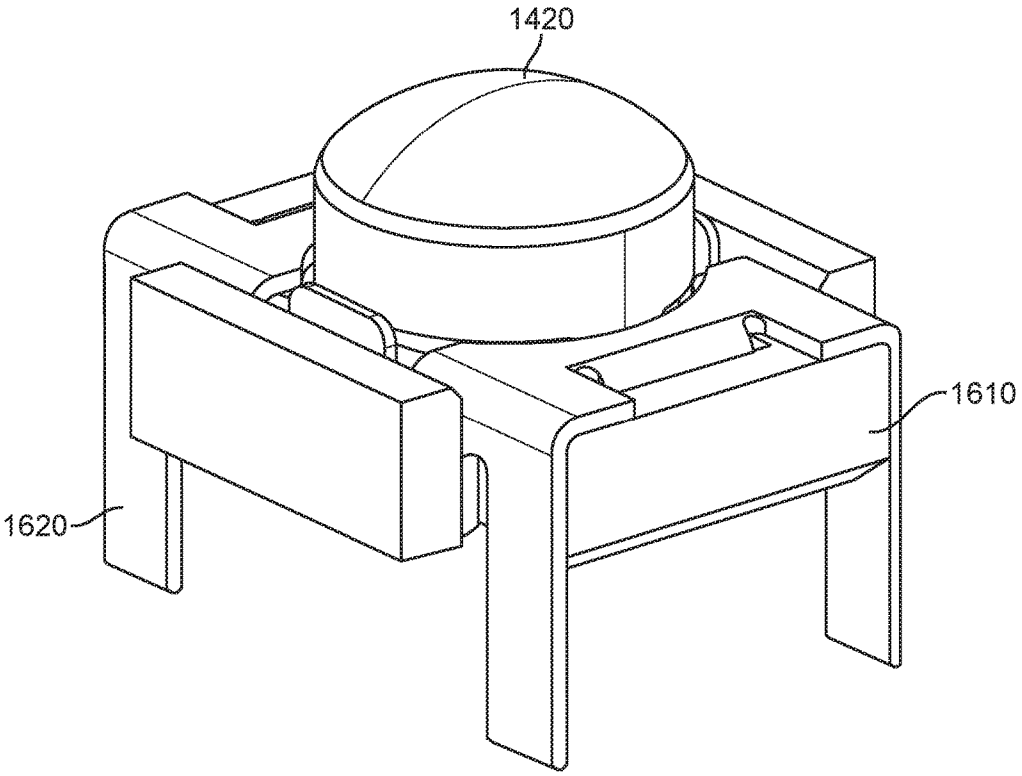
FIG. 16 illustrates a spring-biased contact according to an embodiment of the present invention.

FIG. 16 illustrates a spring-biased contact according to an embodiment of the present invention. This spring-biased contact may include a contacting portion 1420 supported by housing 1610. Terminal structure 1620 may include legs that may be inserted into openings in a flexible circuit board, printed circuit board, or other appropriate substrate.

Figure 17:
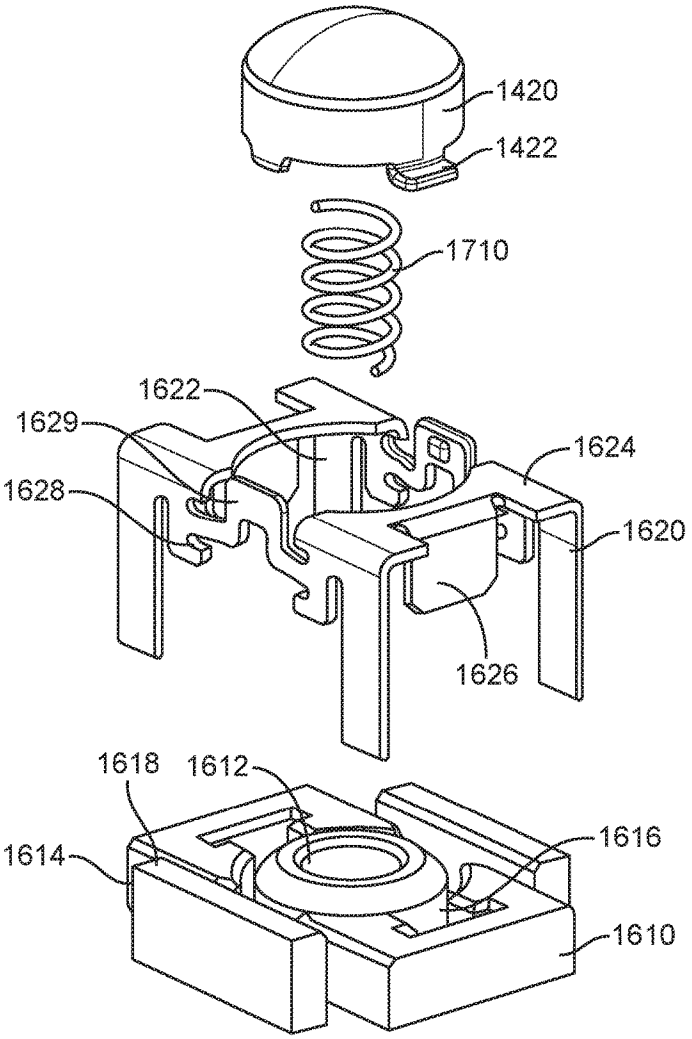
FIG. 17 is an exploded view of a spring-biased contact of FIG. 16.

FIG. 17 is an exploded view of a spring-biased contact of FIG. 16. In this example, housing 1610 may include a central opening 1612. A first end of spring 1710 may be inserted into central opening 1612. Housing 1610 may further include notches 1616 and 1618, as well as corner notches 1614.

A contacting portion 1420 may have a backside cavity (not shown.) A second end of spring 1710 may be inserted into the backside cavity of contacting portion 1420.

Terminal structure 1620 may be fit over contacting portion 1420 such that contacting portion 1420 passes through central opening 1622 of terminal structure 1620. Terminal structure 1620 may include legs which may fit in corner notches 1614. Tabs 1628 and 1626 may fit in notches 1618 and 1616 in housing 1610 to secure terminal structure 1620 in place relative to housing 1610. Contacting portion 1420 may include tabs 1422, which may fit under terminal structure 1620 near portion 1624 to hold contacting portion 1420 in place. Tabs 1628 may include raised portions 1629, which may fit in the back side cavity of contacting portion 1420. Tabs 1629 may help to ensure that electrical contact remains between contacting portion 1420 and terminal 1620 as the contacting portion 1420 is depressed towards housing 1610.

Figure 18:
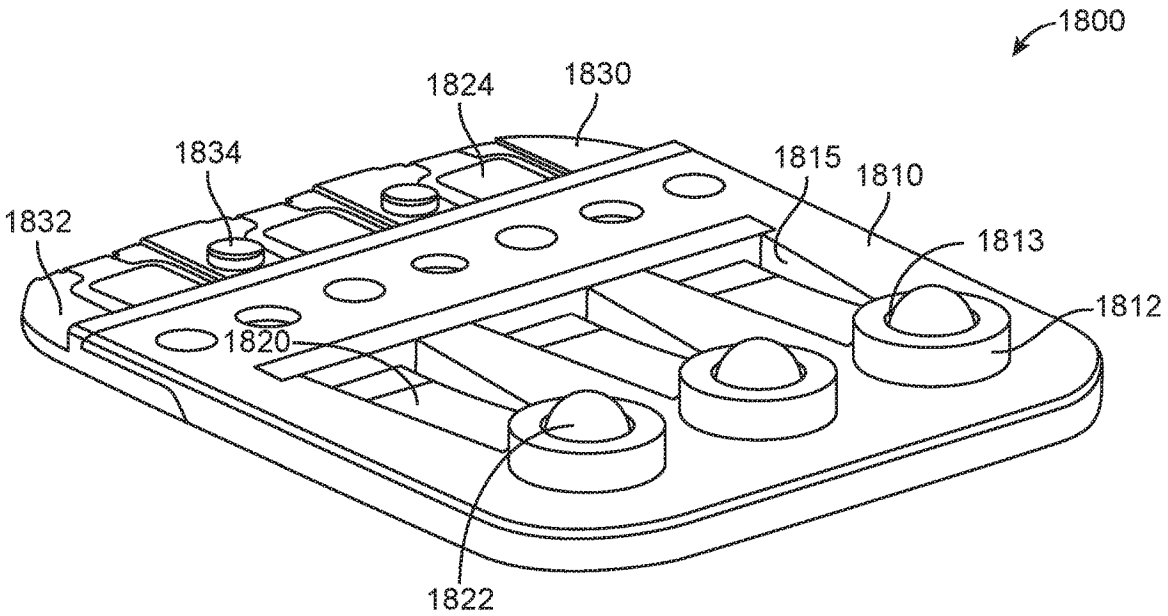
FIG. 18 illustrates another contact assembly according to an embodiment of the present invention.

FIG. 18 illustrates another contact assembly according to an embodiment of the present invention. This example illustrates contact assembly 1800 having a housing 1810 supporting a number of contacts 1820. Contacts 1820 may be located in slots 1815 of housing 1810. Contacts 1820 may include contacting portions 1822 which may extend through openings 1813 in raised portions 1812. In this example, individual raised portions 1812 may partially surround each contacting portion 1822, though in other embodiments of the present invention, raised portions 1812 may be combined into a single raised portion. A portion of contacts 1820 may be encased in injection molding 1830, which may be formed adjacent to housing 1810 in order to secure contacts 1820 to housing 1810. Contact assembly 1800 may attach and be electrically connected to traces of flexible circuit board 2220 (shown in FIG. 22). Specifically, tail portions 1824 of contacts 1820 may be soldered to traces or contacts on flexible circuit board 2220. Posts 1834 may be used to align the flexible circuit board 2220 to contact assembly 1800.

Figure 19:
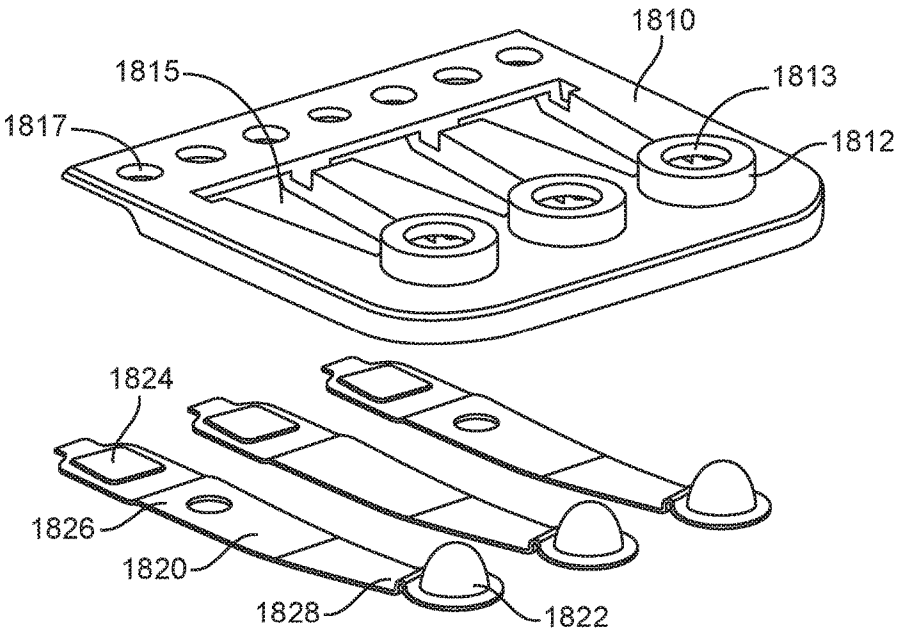
FIG. 19 illustrates a housing and contacts for a contact assembly according to an embodiment of the present invention.

FIG. 19 illustrates a housing and contacts for a contact assembly according to an embodiment of the present invention. Housing 1810 may include raised portions 1812 having openings 1813. Slots 1815 may be available for contacts 1820. Openings 1817 in housing 1810 may be used as an opening to inject injection molding 1830 (shown in FIG. 18) during assembly. Contacts 1820 may include a midsection 1826 that may be encased by injection molding 1830, as shown in FIG. 18. Contacts 1820 may further include a flexible arm 1828. Flexible arm 1828 may be able to deflect in a downward direction (into housing 1810) when contacting portion 1822 is mated with a corresponding contact on a second device. Contacting portion 1822 may be stamped at an end of flexible arm 1828 or it may be a separate structure attached to flexible arm 1828. For example, contacting portion 1822 may be a separate piece that is riveted to flexible arm 1828, as described above in FIG. 5 and related figures. The flexible arm 1828 may be pre-biased to hold contacting portions 1822 in position extending through raised portions 1812 of housing 1810.

Contact assembly 1800 may further include a bottom plate. This bottom plate may be formed of glass or other material that is thin and provides minimal thickness, high stiffness and rigidity, and good insulation. An example is shown in the following figure.

Figure 20:
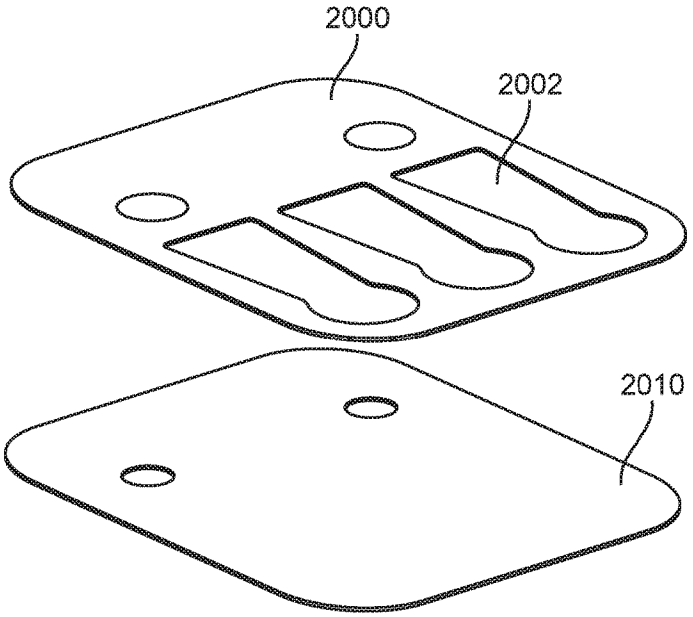
FIG. 20 illustrates a bottom plate an adhesive layer according to an embodiment of the present invention.

FIG. 20 illustrates a bottom plate and an adhesive layer according to an embodiment of the present invention. Bottom plate 2010 may be attached to an underside of housing 1810 (shown in FIG. 19) by adhesive layer 2000. Adhesive layer 2000 may include openings 2002 to prevent flexible arms 1828 of contacts 1820 (shown in FIG. 19) from becoming fixed to adhesive layer 2000. In these and other embodiments of the present invention, adhesive layer 2000 may be a pressure-sensitive adhesive. Bottom plate 2010 may be glass or other composite material to provide minimal thickness, high stiffness and rigidity, and good insulation.

Contact assembly 1800 may be fixed to an inside surface of a device enclosure (not shown.) The low-profile of contact assembly 1800 may allow its use in devices having a thin device enclosure 2210 (shown in FIG. 22.) Contact assembly 1800 may be fixed to the inside surface of device enclosure 2210 (shown in FIG. 22) using a layer of adhesive. An example is shown in the following figure.

Figure 21:
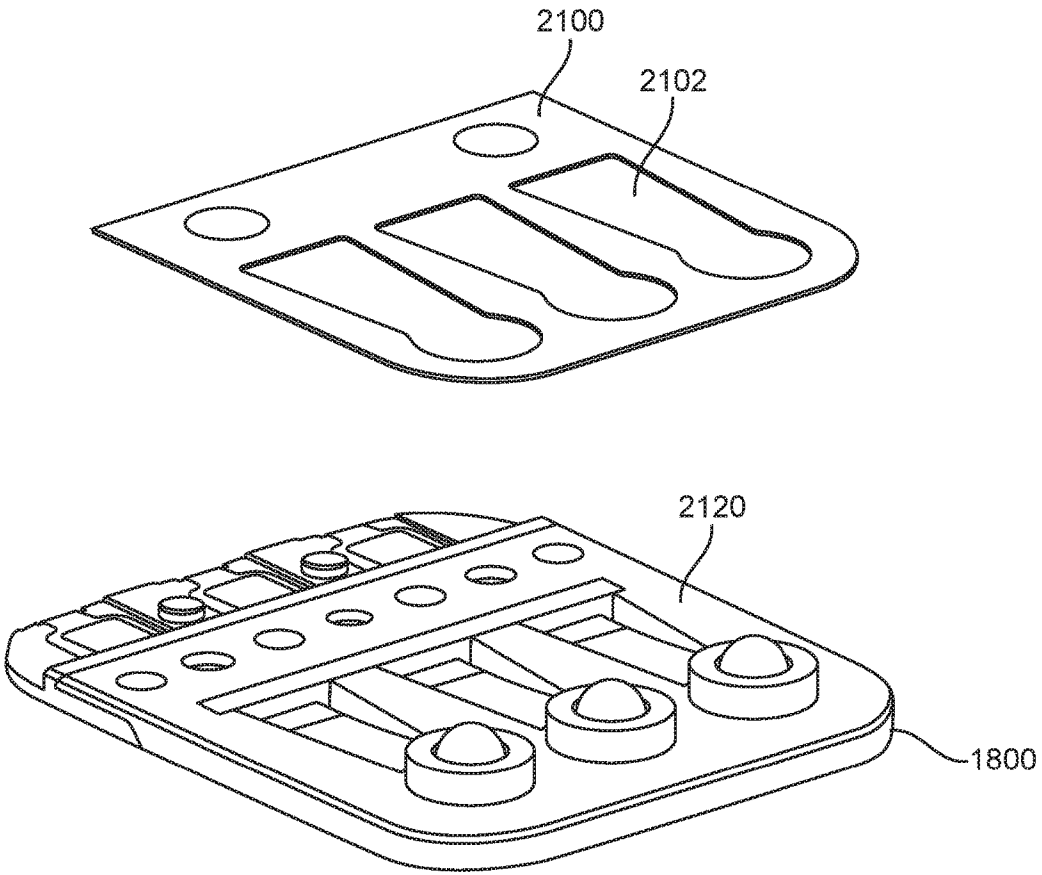
FIG. 21 illustrates a layer of adhesive that may be used to attach a contact structure to an inside surface of a device enclosure according to an embodiment of the present invention.

FIG. 21 illustrates a layer of adhesive that may be used to attach a contact structure to an inside surface of a device enclosure according to an embodiment of the present invention. In this example, contact assembly 1800 may include a top surface 2120. Adhesive layer 2100 may be attached to top surface 2120 in order to secure contact assembly 1800 to an inside surface of device enclosure 2210. Adhesive layer 2100 may include openings 2102. Openings 2102 may help to prevent flexible arms 8028 from becoming fixed to adhesive layer 2100. In these and other embodiments of the present invention, adhesive layer 2100 may be a pressure-sensitive adhesive. Adhesive layer 2100 may stop at backside 1832, or it may continue over a portion of flexible circuit board 2220 (shown in FIG. 22) to secure a portion of flexible circuit board 2220 between tail portions 1824 of contacts 1820 and device enclosure 2210 (shown in FIG. 22.)

Figure 22:
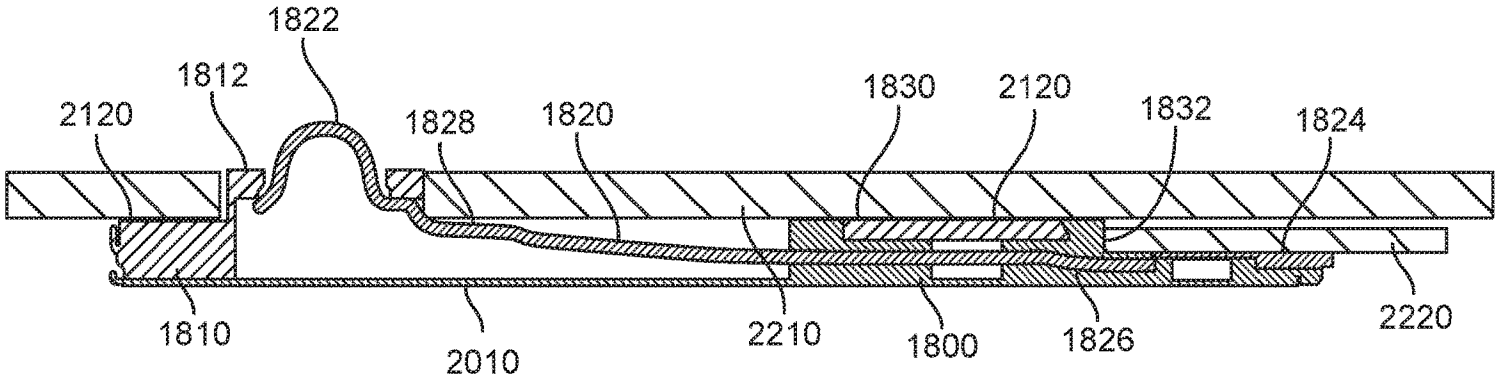
FIG. 22 is a side view of the contact assembly of FIG. 18.

FIG. 22 is a side view of the contact assembly of FIG. 18. In this example, contacts 1820 may be located in housing 1810. Injection molding 1830 may be formed around and midsections 1826 of contacts 1820 to secure contacts 1820 to housing 1810. Contacts 1820 may include flexible arm 1828, which may terminate in contacting portion 1822. Flexible arm 1828 may allow contacting portion 1822 to be depressed in a downward direction towards bottom plate 2010. Contacts 1820 may further include tail portions 1824 for connecting with flexible circuit board 2220. This flexible circuit board 2220 may be flush with a backside 1832 of injection molding 1830. Flexible circuit board 2220 may have a similar height and may form a coplanar surface with top surfaces 2120 of housing 1810. In this way, contact assembly 1800 and a flexible circuit board may reside against an inside surface of device enclosure 2210 Bottom plate 2010 may be fixed to housing 1810 with a first layer of adhesive 200 (shown in FIG. 20.) A second adhesive layer 2100 (shown in FIG. 21) may be applied to top surfaces 2120, which may fix contact assembly 1800 to the inside surface of device enclosure 2210.

Embodiments of the present invention may provide methods of coating contacts to provide a specific color. The color may be selected to match a color of a portion of a device enclosure for the electronic device housing the contacts. For example, the color of the contacts may be chosen to match a portion of the device enclosure that surrounds or is near the contacts. This may provide an electronic device where the contacts and at least a portion of the device enclosure appear to be made of the same material. This uniform appearance may enhance the perceived quality and value of the electronic device.

These and other embodiments of the present invention may instead provide methods of coating contacts to provide a color to contrast with a color of a portion of a device enclosure for the electronic device housing the contacts. This color may be a noticeable color that allows a user to find the contacts quickly for mating with contacts of a second or accessory device. This contrasting color may also be chosen to imply a manufacturing source, or to match other electronic devices, such as a second or accessory device.

In these and other embodiments of the present invention, the contacts may have a specific finish, such as a matte or gloss finish. The color may also have a level of transparency. The contacts may also have more than one color. For example, a logo or other fanciful, identifying, or other information may be conveyed by more than one color on a contact.

These and other embodiments of the present invention may provide electrical contacts having a low contact resistance. For example, these contacts may have a textured surface having patterns of raised areas or ridges. These raised areas or ridges may provide a large number of contacting points between the contacts and corresponding contacts on a second or accessory device when the contacts are mated with the corresponding contacts.

These and other embodiments of the present invention may provide electrical contacts having good corrosion and scratch resistance. For example, a coating to provide color may be placed over a surface of the contact and this additional coating may provide an amount of protection for the contact against corrosion or scratches. Examples are shown in the following figures.

Figure 23:
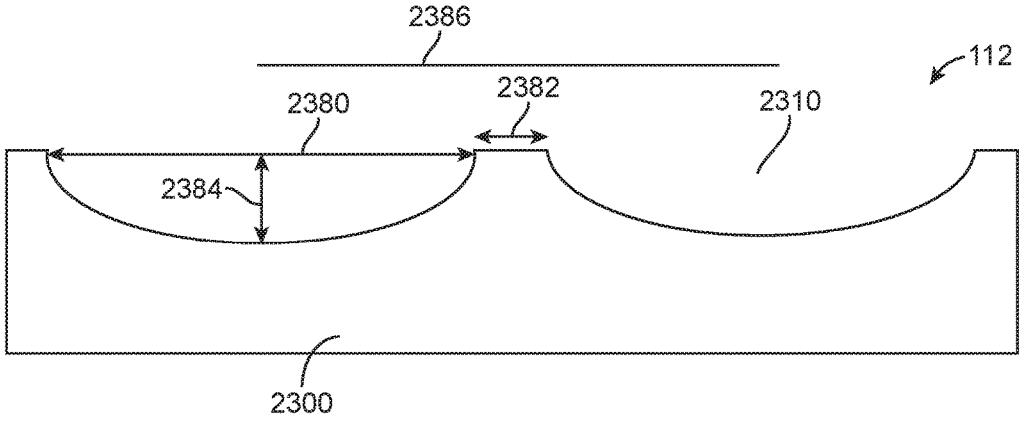

FIGS. 23-31 illustrate methods of manufacturing contacts according to embodiments of the present invention. In FIG. 23, a substrate 2300 for contact 112 may be received. The substrate 2300 may be for a contact 220, or other contact in other devices. The substrate 2300 of contact 112 may be formed of copper, copper alloy, or other material. A number of holes 2310 may be formed in at least a portion of one or more surfaces of contact 112. These holes 2310 may be formed in substrate 2300 of contact 112 in various ways. Holes 2310 may be sandblasted, chemically etched, formed using photolithography, laser etched, stamped, coined, 3-D printed, metal-injection molded, printed, cast, or they may be formed in other ways. To avoid the appearance of lines or other artifacts in the pattern of holes, the location of the holes may be varied or randomized. For example, a laser may have a portion of its position information for some or all of the holes varied or randomized in order to disperse straight lines or other regular patterns that might otherwise be visible.

In these and other embodiments of the present invention, the holes may have various sizes or diameters 2380 and spacings 2382. For example, the diameter 2380 of holes 2310 may be less than 20 microns, 20-40 microns, 40 microns, 42 microns, 40-45 microns, 45 microns, 48 microns, 55 microns, 52-58 microns, or more than 60 microns. Holes 2310 may have a depth 2384 of less than 5 microns, 5-10 microns, 8 microns, 10 microns, 10-30 microns, 12 microns, 13 microns, 15 microns, 20 microns, 20-25 microns, or more than 25 microns. Holes may have a center-to-center pitch 2386 of less than 20 microns, 20-50 microns, 40 microns, 50 microns, 30-60 microns, 50 microns, 60 microns, 70 microns, 50-70 microns, or more than 70 microns. Holes 2310 may have a spacing 2382 of less than 5 microns, 5-10 microns, 10 microns, 20 microns, 10-20 microns, 15 microns, 20 microns, 25 microns, 15-25 microns, or more than 25 microns. The spacing 2382 or center-to-center pitch 2386 of holes 2310 may be varied or randomized to avoid visible patterns formed by the holes. For example, the X and Y coordinates of holes 2310 may be varied in a range such as a plus or minus 3, 4, 5, or more than 5 micron range. These values may be stored in a table and used to vary a target for a laser forming the holes. Light and dark spots may be reduced or removed by adjusting values in the table.

Figure 24:
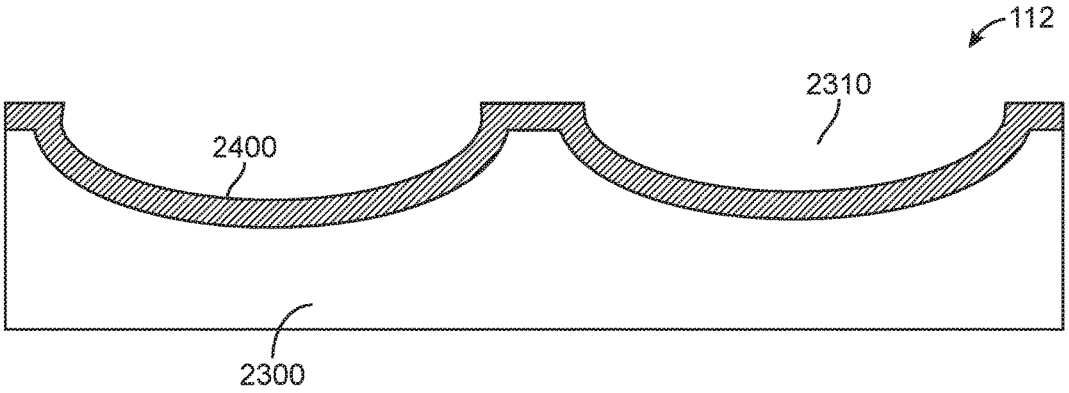

In FIG. 24, holes 2310 in substrate 2300 of contact 112 may be plated with one or more plating layers 2400. These layers may include a top plate that may be formed over contact 112 to provide corrosion and scratch protection. This top plate may be formed of rhodium ruthenium or other material. A barrier layer may be formed over contact 112 before the top plate is formed to prevent discoloration of the top plate by the copper substrate 2300. The barrier layer may be tin-copper, nickel, palladium, silver, tin-copper-nickel, copper-nickel, tin-nickel, nickel-tungsten, electroless nickel, or other material. One or more adhesion layers may be applied before or after the barrier layer, or both. These adhesion layers may be a gold flash or other layer. Other layers may also be included. For example, a layer of nickel-tungsten alloy, tin-nickel, electroless nickel, copper-nickel, silver, or other material may be plated or formed over the substrate before the barrier layer. Other combinations, such as a top plate of rhodium ruthenium over silver, palladium, nickel, electroless nickel, a nickel-tungsten alloy, tin-nickel, tin-copper, tin-copper-nickel, copper-nickel, tin-nickel, nickel-tungsten, or other nickel alloy may be used, where one or more gold layers may be included. Layers of gold over nickel may be used in these and other embodiments of the present invention. Additional steps, such as electro-polishing or copper plating may be performed on the substrate after the holes have been formed and before plating to smooth areas damaged by the laser. In these and other embodiments of the present invention, these layers may be formed by sputtering, vapor deposition, electroplating, or other method. In these and other embodiments of the present invention, the order of these steps may be varied. For example, a substrate 2300 may be plated before holes 2310 are formed.

Figure 25:
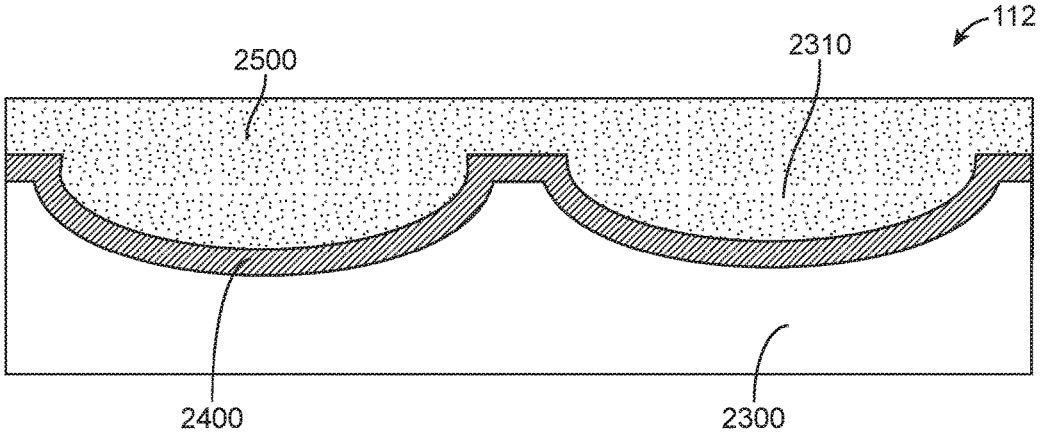

In FIG. 25, a dyed silicon-based polymer 2500 may be applied as a gelatinous or viscous solution to one or more surfaces of contact 112. The dyed silicon-based polymer 2500 may be a sol-gel formed using a sol-gel process such as the Stöber process. In these and other embodiments of the present invention, tetraethyl orthosilicate (TEOS) may be hydrolyzed to form a silicon oxide network, which may be more generally referred to as a sol-gel. In these and other embodiments of the present invention, instead of hydrolyzing, a similar process using a solvent may be employed. The sol-gel may be dyed and applied to at least a portion of one or more surfaces of contact 112. A solvent may then be applied to the sol-gel. Both the sol-gel and the solvent may be applied by spraying, printing, or by other method. The sol-gel may then be dried or cured. The drying or curing may take place at room or an elevated temperature. The die particles in the sol-gel may begin to aggregate as the sol-gel is dried and cured. As the curing process continues, the sol-gel may become more gelatinous and the aggregations of dyed particles may begin to themselves aggregate. The sol-gel may then become a solid as it contracts into the holes and pulls back from the raised portions and ridges. The optional solvent may help to prevent cracking and other damage to the sol-gel by removing water from the sol-gel during curing. The dried sol-gel may consume as little as eight percent of the original volume of the hydrolyzed sol-gel. In these and other embodiments of the present invention, instead of a silicon-based polymer, a germanium-based polymer may be used.

Figure 26:
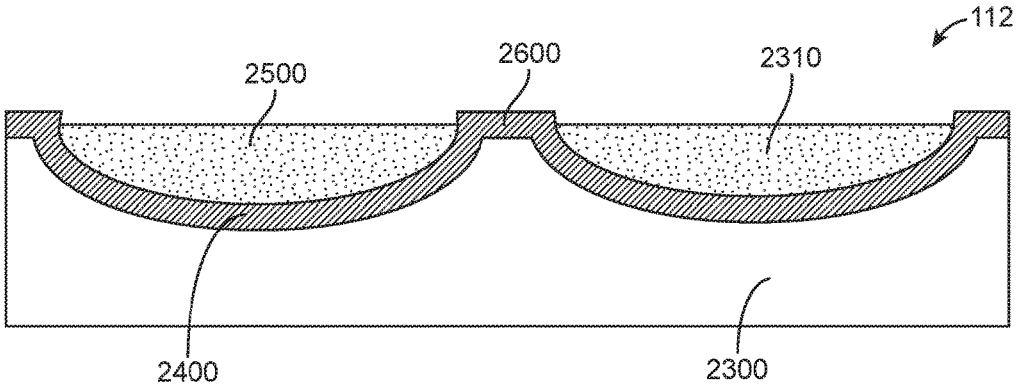

In FIG. 26, after curing, the sol-gel may contract to fill holes 2310, leaving the surrounding raised portions and ridges 2600 exposed. That is, the surface tension of the sol-gel may pull the sol-gel away from raised portions and ridges 2600 and into holes 2310. These surrounding raised portions and ridges 2600 may then form an electrical connection with a corresponding contact when contact 112 and the corresponding contact are mated.

In these and other embodiments of the present invention, instead of using a sol-gel, other materials, such as conductive ink or other types of ink may be used. In these and other embodiments of the present invention, paint may be used. For example, a polymeric paint, such as a polytetrafluoroethylene (PTFE) based paint, may be used. These inks or paints may be applied using pad printing, ink-jet printing, 3-D printing, aerosol jet printing, or other types of printing. In these and other embodiments of the present invention, the formation of holes may be optional.

Figure 27:
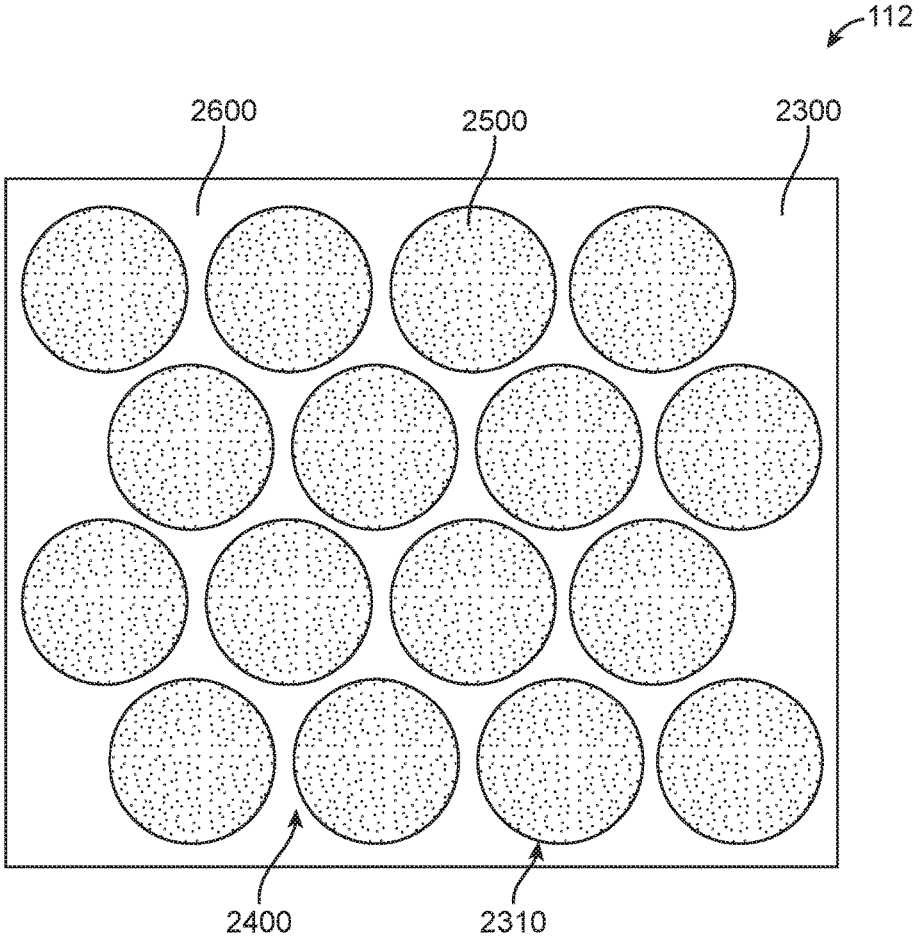
Figure 28:
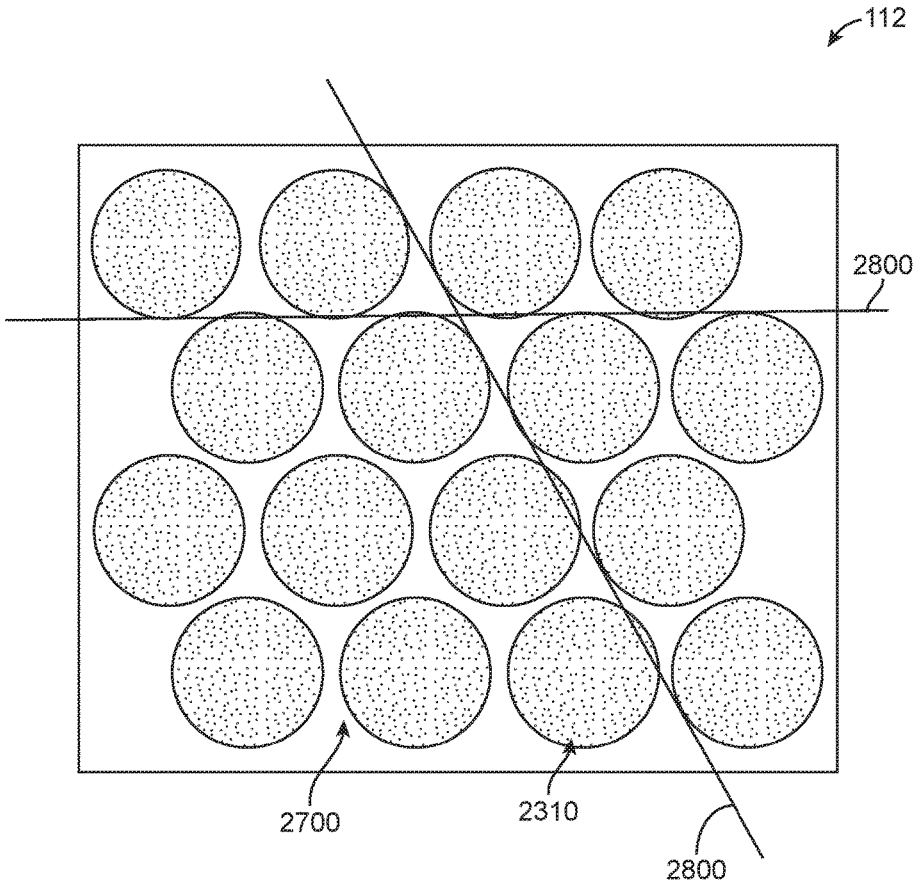

FIG. 27 is a top view of a portion of contact 112 having holes 2310 filled with dried sol-gel (dyed silicon-based polymer 2500) to expose surrounding raised portions and ridges 2600 of plating layers 2400. The pattern of holes 2310 may be a regular, repeating pattern of holes that may form lines of raised portions and ridges 2600 that may be visible. FIG. 28 illustrates lines 2800 that may be visible in a pattern of raised portions and ridges 2600 formed by holes 2310.

Figure 29:
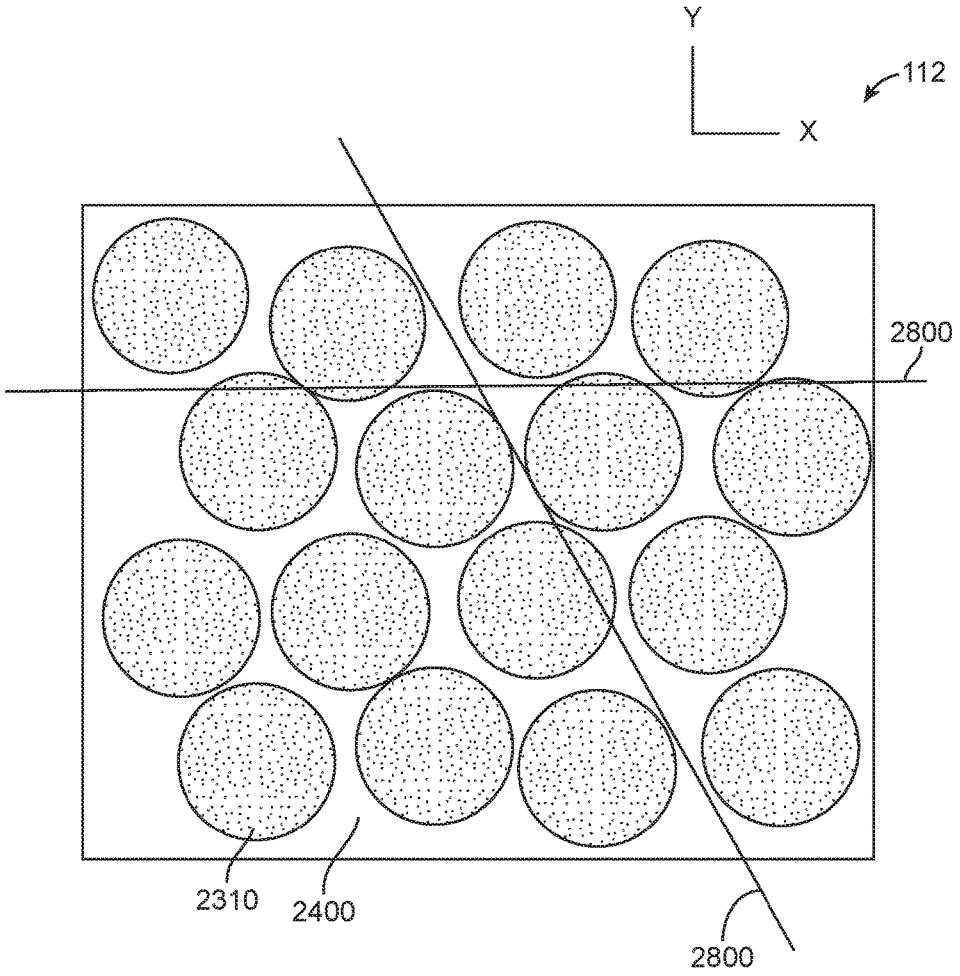

Accordingly, in FIG. 29 the X and Y coordinates of each hole 2310 may be varied or randomized to reduce or eliminate lines 2800. That is, the X and Y coordinates for each hole may be varied from the regular, repeating pattern in FIGS. 6 and 7. For example, the X and Y coordinates of each hole may be modified by a value of −5, −4, −3, −2, −1, 0, 1, 2, 3, 4, 5 microns, where the value is read from a table stored in memory and used to vary a position of a laser forming holes 2310. In this way, a laser may have a portion of its position information for some or all of holes 2310 varied in order to disperse straight lines or other regular or repeating patterns that might otherwise be visible. These tables may be arranged to reduce or eliminate local light and dark regions as well. An example of such as table is shown in FIG. 30. In this table, a variance in what would otherwise be a regular, repeating pattern or array of holes is provided by X and Y values for each point. That is, each point may be a location for a hole in a regular, repeating pattern of holes. This regular, repeating pattern may be varied by moving each hole in an X direction by an amount listed in a corresponding X entry in the X column of the table and by moving each hole in a Y direction by an amount listed in a corresponding Y entry in the Y column of the table. Using these variations, a resulting pattern of holes may appear to be randomized and may have a reduced incidence of regular or repeating lines, patterns, or light or dark areas that may be observable. In these and other embodiments of the present invention, in order to avoid the appearance of lines, light or dark patches, or other artifacts, the depths of the holes may be varied or randomized. In these and other embodiments of the present invention, the diameter of the holes may be varied or randomized. Also, holes may be omitted from areas or regions on contacts where such holes may interfere with further assembly or operation of the contacts. For example, where contacts are located in an injection molded housing, holes may be omitted from areas or regions that are under or near the injection molded housing.

Figure 31:
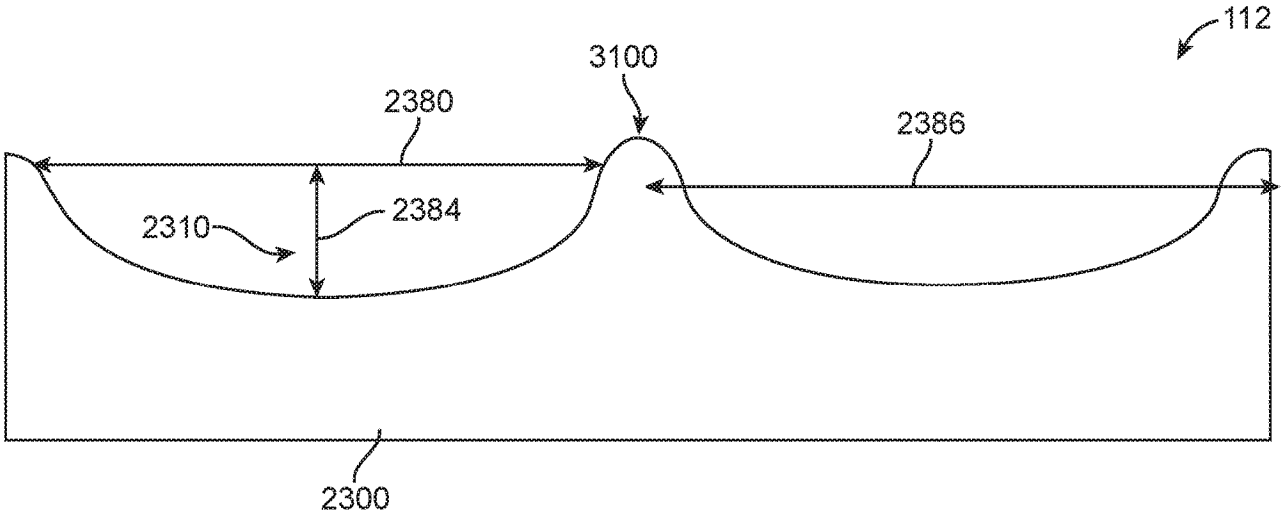

To further reduce reflections from raised portions and ridges 2600, the edges of the raised portions and ridges 2600 may be smoothed or rounded off. For example, after holes 2310 are formed in substrate 2300 of contact 112, substrate 2300 of contact 112 may be etched, polished, or otherwise rounded off before being plated with plating layers 2400. In FIG. 31, surface 3100 has been rounded off. Holes 2310 may have similar depths 2384, diameters 2380, and center-to-center pitches 2386 a shown above.

The methods shown in the above figures may be applied to contacts having surfaces of various contours. For example, it may be applied to contacts having a flat surface. They may also be applied to contacts having curved, round, dome shaped, or other shaped contacting portions. An example is shown in the following figure.

Figure 32:
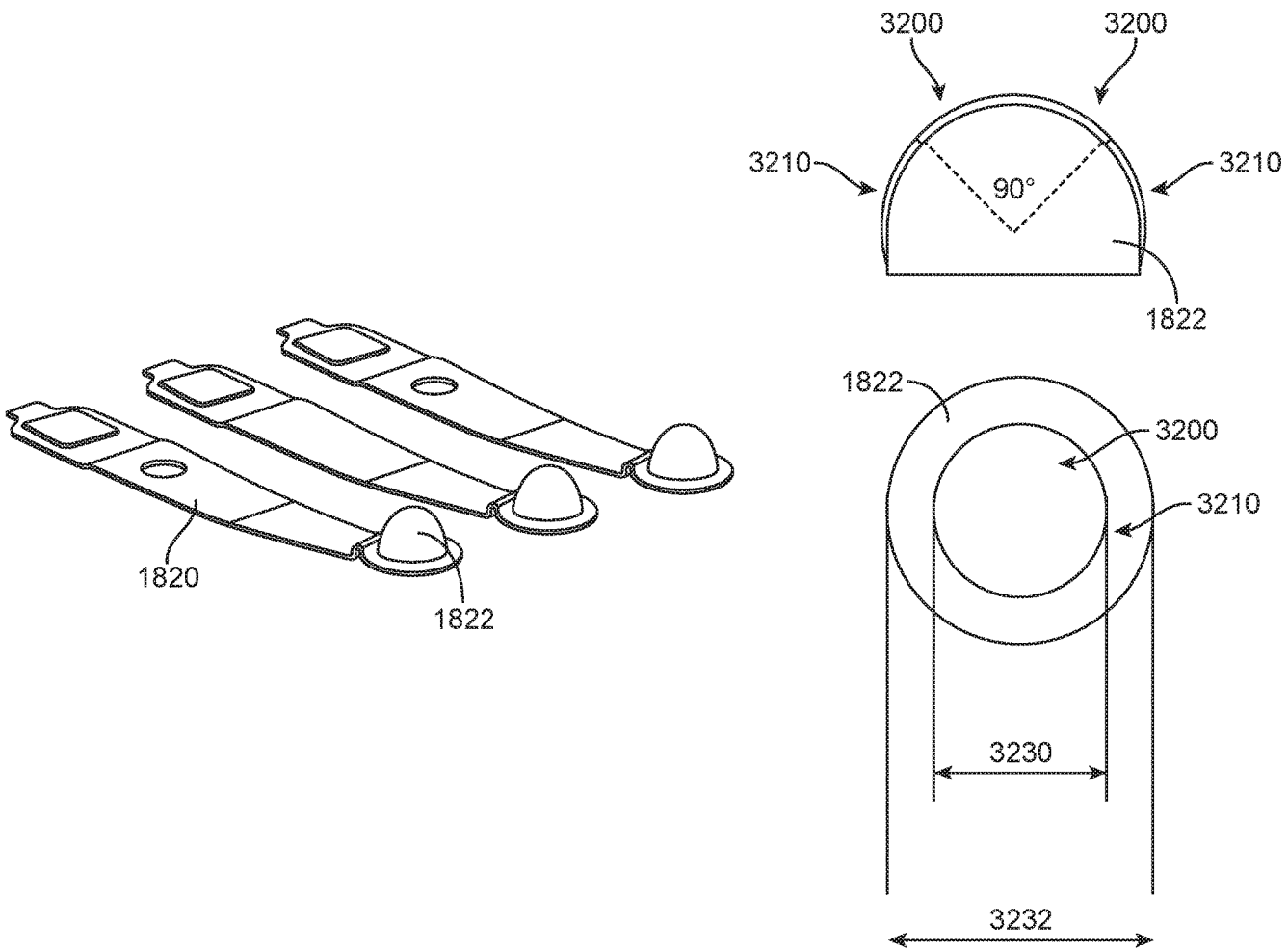
FIG. 32 illustrates a method of manufacturing a dome shaped contact according to an embodiment of the present invention.

FIG. 32 illustrates a method of manufacturing a dome shaped contact according to an embodiment of the present invention. As shown in FIG. 19 and repeated here, contacts 1820 may include contacting portions 1822. It may be difficult to form holes in a surface of contacting portions 1822 due to its domed or curved shape. Accordingly, embodiments of the present invention may form holes in a top portion of the contacting portion 1822. For example, holes may be formed in areas 3200, while holes are not formed in areas 3210. The sol-gel and other layers may be applied to both surface portions. In these and various embodiments of the present invention, sol-gel may be applied to area 3210 and 3200 of contacting portions 1822. Area 3210 may have a diameter 3232. Holes may be generated in area 3200, which may have a smaller diameter 3230. In other embodiments of the present invention, contacting portions 1822 may be rotated in one or more dimensions to increase an area where holes may be formed.

In various embodiments of the present invention, different portions of this contact structure and other contact structures may be formed of various materials. For example, cap 1410 and gaskets 1520 may be formed of the same or different materials, such as plastic, LPS, or other non-conductive material. Contacting portions of spring-biased contacts 1420 may be formed of noncorrosive materials, such as gold, gold plated copper, gold plated nickel, gold-nickel alloy, and other materials. Bracket 1430 may be formed of sheet metal or other material.

In various embodiments of the present invention, different portions of this contact structure and other contact structures may be formed in various ways. For example, cap 1410 and gaskets 1520 may be formed using injection or other molding, printing, or other technique. Contact portions and other conductive portions of contacts 1420 may be machined, stamped, coined, forged, printed, or formed in different ways.

Embodiments of the present invention may provide contact structures that may be located in various types of devices, such as portable computing devices, tablet computers, desktop computers, laptops, all-in-one computers, wearable computing devices, cell phones, smart phones, media phones, storage devices, keyboards, covers, cases, portable media players, navigation systems, monitors, power supplies, adapters, remote control devices, chargers, and other devices. These devices may include contact structures that may provide pathways for signals and power compliant with various standards such as one of the Universal Serial Bus (USB) standards including USB Type-C, HDMI, DVI, Ethernet, DisplayPort, Thunderbolt, Lightning, JTAG, TAP, DART, UARTs, clock signals, power signals, and other types of standard, non-standard, and proprietary interfaces and combinations thereof that have been developed, are being developed, or will be developed in the future. In one example, the contact structures may be used to convey a data signal, a power supply, and ground. In various embodiments of the present invention, the data signal may be unidirectional or bidirectional and the power supply may be unidirectional or bidirectional.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A contact structure comprising:

a housing having plurality of slots, a top surface, and at least one raised portion extending from the top surface, where the at least one raised portion includes at least one opening;

a plurality of contacts, each located in a corresponding one of the plurality of slots, each contact comprising a contacting portion and a midsection portion, wherein the contacting portion of each contact extends through a corresponding opening in the at least one raised portion in the housing;

an injection molded portion around the midsection of each contact and adjacent to the housing to secure the plurality of contacts to the housing; and a bottom plate attached to a bottom of the housing.

2. The contact structure of claim 1 wherein the contacting portion of each of the plurality of contacts has a dome shape.

3. The contact structure of claim 2 wherein each contacting portion is stamped at an end of a contact in the plurality of contacts.

4. The contact structure of claim 3 wherein each contact in the plurality of contacts comprises a tail portion to attach to a flexible circuit board.

5. The contact structure of claim 4 wherein the bottom plate is attached to the housing with a first layer of adhesive.

6. The contact structure of claim 1 wherein the bottom plate is formed of glass.

7. The contact structure of claim 6 wherein each contact further comprises a flexible arm between the midsection and the contacting portion.

8. The contact structure of claim 7 wherein for each contact in the plurality of contacts, the flexible arm allows the contacting portion to be depressed towards the bottom plate.

9. The contact structure of claim 8 further comprising a second layer of adhesive over the top surface of the housing.

10. An electronic device comprising:

a device enclosure substantially housing the electronic device;

a contact structure comprising:

a housing having plurality of slots, at least one raised portion, and a top surface, where the at least one raised portion includes at least one opening;

a plurality of contacts each located in a corresponding one of the plurality of slots, each contact comprising a contacting portion, a midsection portion, and a tail portion, wherein the contacting portion of each contact extends through a corresponding opening in the at least one raised portion in the housing;

an injection molded portion around the midsection of each contact and adjacent to the housing to secure the plurality of contacts to the housing; and a bottom plate attached to the bottom of the housing; and a flexible circuit board coupled to the tail portion of each of the plurality of contacts.

11. The contact structure of claim 10 further comprising a second layer of adhesive between the top surface of the housing and the device enclosure.

12. The contact structure of claim 10 wherein the contacting portion of each of the plurality of contacts has a dome shape.

13. The contact structure of claim 12 wherein each contacting portion is stamped at an end of a contact in the plurality of contacts.

14. The contact structure of claim 13 wherein the bottom plate is attached to the housing with a first layer of adhesive.

15. The contact structure of claim 14 wherein the bottom plate is formed of glass.

16. A contact structure comprising:

a housing having plurality of slots, a top surface, and a plurality of raised portions extending from the top surface, where each of the plurality of raised portions includes an opening;

a plurality of contacts, each located in a corresponding one of the plurality of slots, each contact comprising a contacting portion and a midsection portion, wherein the contacting portion of each contact extends through a corresponding opening in a corresponding raised portion of the housing;

an injection molded portion around the midsection of each contact and adjacent to the housing to secure the plurality of contacts to the housing; and a bottom plate attached to a bottom of the housing.

17. The contact structure of claim 16 wherein the bottom plate is formed of glass.

18. The contact structure of claim 16 wherein the contacting portion of each of the plurality of contacts has a dome shape.

19. The contact structure of claim 18 wherein each contacting portion is stamped at an end of a contact in the plurality of contacts.

20. The contact structure of claim 19 wherein each contact in the plurality of contacts comprises a tail portion to attach to a flexible circuit board.

* * * * *